US007066782B1

(12) United States Patent
Maddocks et al.

(10) Patent No.: US 7,066,782 B1
(45) Date of Patent: Jun. 27, 2006

(54) ELECTROMECHANICAL TOY

(75) Inventors: Richard Maddocks, Barrington, RI (US); Jeffrey M. Ford, Warwick, RI (US)

(73) Assignee: Hasbro, Inc., Pawtucket, RI (US)

( * ) Notice: Subject to any disclaimer, the term of this patent is extended or adjusted under 35 U.S.C. 154(b) by 56 days.

(21) Appl. No.: 10/667,977

(22) Filed: Sep. 23, 2003

Related U.S. Application Data

(63) Continuation-in-part of application No. 10/305,265, filed on Nov. 27, 2002, and a continuation-in-part of application No. 10/073,122, filed on Feb. 12, 2002, now Pat. No. 6,773,327.

(51) Int. Cl.
*A63H 13/00* (2006.01)

(52) U.S. Cl. ..... 446/280; 446/269; 446/353

(58) Field of Classification Search ..... 446/330, 446/352, 353, 356, 269, 272, 277, 276, 280
See application file for complete search history.

(56) References Cited

U.S. PATENT DOCUMENTS

| | | | | |
|---|---|---|---|---|
| 112,550 | A | 3/1871 | Clay | |
| 1,574,035 | A * | 2/1926 | Holtzman | 446/292 |
| 1,639,442 | A | 8/1927 | Strauss et al. | |
| 1,992,477 | A | 2/1935 | Domowitch et al. | |
| 2,194,537 | A | 3/1940 | Adams | |
| 2,421,279 | A | 5/1947 | Marty | |
| 2,614,365 | A | 10/1952 | White et al. | |
| 2,620,594 | A | 12/1952 | Parisi | |
| 3,266,059 | A | 8/1966 | Stelle | |
| 3,484,988 | A | 12/1969 | Robbins | |
| 3,705,387 | A * | 12/1972 | Stern et al. | 446/460 |
| 3,940,879 | A | 3/1976 | Glass et al. | |
| 3,981,098 | A | 9/1976 | Darda | |
| 4,086,724 | A | 5/1978 | McCaslin | |
| 4,109,913 | A | 8/1978 | Nielsen | |
| 4,125,261 | A | 11/1978 | Lahr | |
| 4,155,197 | A | 5/1979 | Beny et al. | |
| 4,165,581 | A | 8/1979 | Wolf | |
| 4,224,759 | A | 9/1980 | Saint-Pierre et al. | |
| 4,231,183 | A | 11/1980 | Lahr | |
| 4,245,515 | A | 1/1981 | Iwaya | |
| 4,248,012 | A | 2/1981 | Kirby et al. | |
| 4,276,717 | A | 7/1981 | Zbriger et al. | |
| 4,333,261 | A | 6/1982 | Jones et al. | |
| 4,363,187 | A | 12/1982 | Shinohara | |

(Continued)

FOREIGN PATENT DOCUMENTS

DE 19755465 A1 12/1997

(Continued)

OTHER PUBLICATIONS

U.S. Appl. No. 10/425,992, filed Apr. 30, 2003.

(Continued)

*Primary Examiner*—John A. Ricci
(74) *Attorney, Agent, or Firm*—Fish & Richardson P.C.

(57) ABSTRACT

A toy is configured to closely resemble a live animal and to respond to stimuli in a realistic manner that is consistent with the way in which a real animal would respond. For example, when the toy is designed to resemble a dog or a cat, the toy may be configured to move in a manner consistent with the movements of a dog or a cat. This realistic movement, in conjunction with a realistic fur coat coupled to and covering inner mechanical components, may be used to provide a strikingly realistic toy.

42 Claims, 36 Drawing Sheets

U.S. PATENT DOCUMENTS 4,453,712 A 6/1984 Lee
4,479,327 A 10/1984 Wakimura
4,494,417 A 1/1985 Larson et al.
4,516,951 A 5/1985 Saigo et al.
4,540,176 A 9/1985 Baer
4,571,208 A 2/1986 Saigo et al.
4,573,941 A * 3/1986 Holden et al. ..... 446/451
4,595,381 A 6/1986 Dibold et al.
4,601,671 A 7/1986 DeMars
4,636,177 A 1/1987 Koguchi
4,655,724 A 4/1987 Law
4,662,854 A 5/1987 Fang
4,673,371 A 6/1987 Furukawa
4,708,688 A 11/1987 Lee
4,717,364 A 1/1988 Furukawa
4,795,395 A 1/1989 Oishi et al.
4,798,553 A 1/1989 Gentles et al.
4,802,878 A 2/1989 Terzian et al.
4,810,226 A * 3/1989 Takahashi et al. ..... 446/300
4,815,911 A 3/1989 Bengtsson et al.
4,822,285 A * 4/1989 Summerville ..... 434/272
4,828,525 A 5/1989 Okano
4,846,756 A 7/1989 Hesse
4,909,770 A * 3/1990 Hesse ..... 446/455
4,923,428 A 5/1990 Curran
4,944,708 A 7/1990 Kawabe
4,968,280 A 11/1990 Kelley
5,011,449 A 4/1991 Handy et al.
5,030,160 A * 7/1991 Klawitter ..... 446/242
5,056,249 A 10/1991 Sakurai
5,080,681 A 1/1992 Erb
5,080,682 A 1/1992 Schectman
5,141,464 A 8/1992 Stern et al.
5,158,492 A 10/1992 Rudell et al.
5,195,920 A 3/1993 Collier
5,267,886 A 12/1993 Wood et al.
5,295,893 A 3/1994 Chiu
5,297,443 A 3/1994 Wentz
5,324,225 A 6/1994 Satoh et al.
5,378,188 A 1/1995 Clark
5,409,447 A 4/1995 Wedge, Jr.
5,498,193 A 3/1996 Locricchio
5,505,493 A * 4/1996 Camfield et al. ..... 280/828
5,647,787 A 7/1997 Raviv et al.
5,697,829 A 12/1997 Chainani et al.
5,724,074 A 3/1998 Chainani et al.
5,846,115 A 12/1998 Feng
5,908,345 A 6/1999 Choi
5,931,715 A 8/1999 Chang
6,053,797 A 4/2000 Tsang et al.
6,083,104 A 7/2000 Choi
6,139,394 A 10/2000 Maxim
6,149,490 A 11/2000 Hampton et al.
6,160,986 A 12/2000 Gabai et al.
6,200,190 B1 3/2001 Reynolds
6,200,193 B1 3/2001 Nadel
6,250,987 B1 6/2001 Choi
6,253,058 B1 6/2001 Murasaki et al.
6,322,420 B1 11/2001 Daniellian
6,350,170 B1 * 2/2002 Liu ..... 446/353
6,371,826 B1 4/2002 Pestonji
6,386,943 B1 5/2002 Chang
6,390,883 B1 5/2002 Choi
6,402,153 B1 6/2002 Stewart
6,435,936 B1 8/2002 Rehkemper et al.
6,458,010 B1 10/2002 Yamagishi et al.
6,461,218 B1 * 10/2002 Mullaney et al. ..... 446/330
6,471,565 B1 10/2002 Simeray
6,497,607 B1 12/2002 Hampton et al.
6,514,117 B1 2/2003 Hampton et al.
6,565,407 B1 5/2003 Woolington et al.
6,602,106 B1 8/2003 Cheung
6,652,353 B1 11/2003 Lund et al.
6,666,744 B1 12/2003 Llorens
6,695,672 B1 2/2004 Rehkemper et al.

FOREIGN PATENT DOCUMENTS

EP 641580 A1 * 3/1995
GB 2221401 A 2/1990
GB 2222959 A 3/1990
JP 11-207042 8/1999
JP 2001-300149 10/2001

OTHER PUBLICATIONS

U.S. Appl. No. 10/698,930, filed Nov. 3, 2003.
U.S. Appl. No. 10/305,265, filed Nov. 27, 2002.
The WowWee horse, a toy horse produced by WowWee in 2002 and shown at Toy Fair in Feb., 2003 in NY, NY, 3 pages of photographs.
The Hasbro dog, a toy dog produced and sold by Hasbro in the U.S. before the year 2000, 3 pages of photographs.

* cited by examiner

ELECTROMECHANICAL TOY

CROSS REFERENCE TO RELATED APPLICATIONS

This application is a continuation-in-part of and claims priority to U.S. application Ser. No. 10/073,122, now U.S. Pat. No. 6,773,327, filed Feb. 12, 2002, and U.S. application Ser. No. 10/305,265, filed Nov. 27, 2002, both of which are incorporated herein by reference.

TECHNICAL FIELD

This description relates to an electromechanical toy.

BACKGROUND

Toys that have moving parts are well known. For example, dolls and plush toys such as stuffed animals are made with moveable appendages.

SUMMARY

A toy may be configured to closely resemble a live animal and to respond to stimuli in a realistic manner that is consistent with the way in which a real animal would respond. For example, when the toy is designed to resemble a dog or a cat, the toy may be configured to move in a manner consistent with the movements of a dog or a cat. This realistic movement, in conjunction with a realistic fur coat coupled to and covering inner mechanical components, may be used to provide a strikingly realistic toy.

For example, the toy animal may turn in the direction of a sound or touch. The body of the toy animal may pivot in conjunction with animation of the head of the toy animal, which is attached to the body of the toy animal. The toy animal may wag it's tail and it's back region as it moves forward or backward. The toy animal may include side panels that replicate walking motion of the arms and paws of the toy animal as the toy animal moves forward or backward.

In another general aspect, a toy includes a body, a wheel region that rotates about a wheel axis and is coupled to the body, a back region coupled to the body, and an actuation system within the body. The actuation system is coupled to the back region to oscillate the back region about a back axis perpendicular to the wheel axis as the wheel region rotates.

In an implementation in which the toy is configured to resemble an animal, oscillation of the back region resembles a rear hip motion of the animal as the animal walks.

Implementations may include one or more of the following features. For example, the toy may include a drive wheel region that rotates about a drive wheel axis that is parallel to the wheel axis and causes the body to move in a direction perpendicular to the drive wheel axis. The toy may include a motor, and a second actuating system coupled to the motor and to the drive wheel region to move the body in a direction that is perpendicular to the drive wheel axis. Motion of the body may cause the wheel region to rotate about the wheel axis.

The back region may include a crank attached to a lower surface of the back region and coupled to the actuation system to oscillate the back region as the wheel region rotates. The actuation system may include a crank device attached to the crank, a coupling device attached to the crank device, and a wheel device attached to the coupling device and to the wheel region. The wheel device may be fixed to an axle of the wheel region.

The crank device may include a crank gear, the coupling device may include a coupling gear, and the wheel device may include a wheel gear. Alternatively, the crank device may include a crank pulley, the wheel device may include a wheel pulley, and the coupling device may include a coupling belt that wraps around the crank pulley and the wheel pulley.

The toy may further include a side panel external to and attached to the body, and an actuating device coupled to the wheel region and to the side panel to oscillate the side panel about a side panel axis that is parallel to the wheel axis as the wheel region rotates. The actuating device may include a protrusion on the side panel that engages a cam on the wheel region.

In an implementation in which the toy is configured to resemble an animal, the side panel is configured to resemble the arms or paws of the animal and oscillation of the side panel resembles a back and forth motion of the arms or paws of the animal as the animal walks.

A tail may be connected to the back region to oscillate as the back region oscillates.

The back region may include a back panel and cylindrical projections that extend from side surfaces of the back panel. The cylindrical projections are shaped to fit within cavities of the body. The back axis may be defined by the cylindrical projections.

In an implementation in which the toy is configured to resemble an animal, movement of the the tail resembles a tail wagging motion of the animal as the animal walks.

The toy may also include a motor that causes the toy to move in a forward direction and a backward direction, with both directions being perpendicular to the wheel axis. The toy may include a pendulum rotatably attached to an inside surface of the body and a pivoting member coupled to the pendulum and to a cavity of the body. The pendulum is free to oscillate about an axis that is perpendicular to the direction in which the toy moves. The pivoting member is free to oscillate about a pivot within the cavity. The pendulum may oscillate in response to successive movements of the toy in the forward and backward directions. The pivoting member may oscillate about the pivot in response to oscillation of the pendulum. At least a portion of the pivoting member may be external to the body. The toy may include an output device within the body. The controller causes the output device to output a signal when the pivoting member oscillates.

In an implementation in which the toy is configured to resemble an animal, the pivoting member is configured to resemble the tongue of the animal and oscillation of the pivoting member resembles a panting motion of the animal. In this implementation, the output device may output a panting sound as the pivoting member oscillates.

In another general aspect, a toy includes a body, a controller within the body, a head region coupled to the body, an actuation system coupled to the head region, and a motor within the body. The head region includes an elongated neck device and a head attached to the elongated neck device. The motor is coupled to the controller and to the actuation system to activate the actuation system in response to a signal from the controller. When activated, the actuation system rotates the elongated neck device about a neck axis, rotates the head about a head axis, and rotates the head about a tilt axis that is different from the head axis in response to a signal from the controller.

Implementations may include one or more of the following features. For example, the actuation system may include first and second elongated devices that connect at one end to a pulley coupled to the motor and at another end to a lever within the head region. The first and second elongated devices may extend from the pulley along sides of the elongated neck device, and to the lever. The elongated neck device may include a first end that couples to a post attached to the body, and a second end that couples to the lever. The first end of the elongated neck device may define the neck axis and the second end of the elongated neck device may define the head axis.

The actuation system may include a pivot device that is attached to the lever and the elongated neck device at the second end of the elongated neck device. The pivot device may include a post that defines the tilt axis.

In another general aspect, a method of moving a toy includes rotating an elongated neck device attached to a body of the toy about a neck axis, rotating a head attached to the elongated neck device about a head axis, and rotating the head about a tilt axis that is different from the head axis. All rotations are performed by a motor within the toy body and in response to a signal from a controller within the toy body.

In another general aspect, a method of moving a toy includes rotating a wheel attached to a body of the toy about a wheel axis to cause the body of the toy to move, and pivoting a first portion of the body relative to a second portion of the body about a pivoting axis that is perpendicular to the wheel axis while the body of the toy moves in a direction perpendicular to the wheel axis and the pivoting axis due to rotation of the wheel.

Implementations may include one or more of the following features. For example, the method may also include determining the position of the first body portion relative to the second body portion. Pivoting the first body portion relative to the second body portion may be based on the determined position.

The method may further include oscillating a pendulum rotatably attached to an inside surface of the body about an axis that is perpendicular to the direction in which the toy moves in response to successive movements of the toy in a forward and backward direction, and oscillating a pivoting member coupled to the pendulum and to a cavity of the body in response to oscillation of the pendulum. The method may include outputting a signal to an output device within the body when the pivoting member is oscillating.

In another general aspect, a toy includes a body including a first body portion and a second body portion, a wheel attached to the body of the toy, and an actuation system within the body. The wheel is able to rotate about a wheel axis to cause the body of the toy to move in a direction perpendicular to the wheel axis. The actuation system causes the first body portion to rotate relative to the second body portion about a pivoting axis that is perpendicular to the wheel axis and the direction of motion of the toy.

Implementations may include one or more of the following features. For example, the first body portion may house a wiper contact that includes electrically-conductive paths and the second body portion may house a set of conductive wipers that protrude from a surface of the second body portion and contact the electrically-conductive paths. The toy may include a controller coupled to the electrically-conductive paths to determine a location of the first body portion relative to the second body portion. The toy may also include a sensory region on the body of the toy and coupled to the controller. The controller is coupled to the actuation system to activate the actuation system upon receiving input from the sensory region. The sensory region may include a microphone and the controller may activate the actuation system in response to input from the sensory region that indicates a sound has been detected.

The toy may include a head region attached to the first body portion. The actuation system animates the head region after causing the first body portion to rotate relative to the second body portion.

The toy may further include a pendulum rotatably attached to an inside surface of the body and a pivoting member coupled to the pendulum and to a cavity of the body. The pendulum is free to oscillate about an axis that is perpendicular to the direction in which the toy moves. The pivoting member is free to oscillate about a pivot within the cavity. The pendulum may oscillate in response to successive movements of the toy in forward and backward directions. The pivoting member may oscillate about the pivot in response to oscillation of the pendulum. The toy may include an output device within the body that outputs a signal when the pivoting member oscillates.

In another general aspect, a toy includes a body including a first body portion and a second body portion, a controller within the body, a motor within the body and coupled to the controller, a steering system coupled to the motor and to the body, a head region coupled to the body, and an actuation system coupled to the motor and the head region. The steering system is configured to rotate the first body portion relative to the second body portion. The motor is configured to actuate the steering system to cause the first body portion to rotate relative to the second body portion and to cause the actuation system to animate the head region simultaneously with the relative motion between the first and second body portions when the controller receives a sensed condition.

Implementations may include one or more of the following features. For example, the toy may also include a wheel region attached to the body to rotate about a wheel axis, a second motor, and a second actuating system coupled to the second motor and to the wheel region to move the body in a direction that is perpendicular to the wheel axis. The toy may include a wheel region defining a wheel axis and coupled to the motor to move the toy in a forward direction and a backward direction, with both directions being perpendicular to the wheel axis.

The toy may also include a pendulum rotatably attached to an inside surface of the head region and free to oscillate about an axis that is perpendicular to the direction in which the toy moves, and a pivoting member coupled to the pendulum and to a cavity of the head region, the pivoting member being free to oscillate about a pivot within the cavity. The pendulum may oscillate in response to successive movements of the toy in the forward and backward directions. The pivoting member may oscillate about the pivot in response to oscillation of the pendulum. At least a portion of the pivoting member may be external to the head region. The toy may include an output device within the body. The controller causes the output device to output a signal when the pivoting member oscillates.

The actuation system may include first and second elongated devices that connect at one end to a pulley coupled to the motor and at another end to a lever within the head region. The first and second elongated devices may extend from the pulley along sides of the elongated neck device, and to the lever.

The elongated neck device may include a first end that couples to a post attached to the body, and a second end that couples to the lever. The first end of the elongated neck device may define the neck axis and the second end of the elongated neck device may define the head axis.

The actuation system may animate the head region by rotating the elongated neck device about a neck axis, rotating the head region about a head axis, and rotating the head region about a tilt axis that is different from the head axis in response to a signal from the controller. The actuation system may include a pivot device that is attached to the lever and to the elongated neck device at the second end of the elongated neck device. The pivot device may include a post that defines the tilt axis.

The steering system may cause the first body portion to rotate in a direction relative to the second body portion.

The actuation system may rotate the elongated neck device about the neck axis in a direction that is equivalent to the direction that the first body portion rotates relative to the second body portion.

The actuation system may rotate the elongated neck device about the head axis in a direction that is equivalent to the direction that the first body portion rotates relative to the second body portion.

The steering system may include a steering bar fixed within the first body portion, a hinge device fixed within the second body portion, and linkages that couple the steering bar to the hinge device. Actuation of the steering system may include rotating the steering bar to cause the linkages to move so as to cause the first body portion to move relative to the second body portion.

In another general aspect, a toy includes a body including a first body portion and a second body portion, a sensory region on the body, a controller that receives input from the sensory region on the body, a motor within the body and coupled to the controller, and an actuating system coupled to the motor and to the first and second body portions. The actuation system moves the first body portion relative to the second body portion when the controller receives input from the sensory region. The actuating system moves the first body portion relative to the second body portion in a direction that is based on the location of the sensory region on the body.

Implementations may include one or more of the following features. For example, the sensory region may include a touch-sensitive device. The touch-sensitive device may include a capacitively-coupled device or an inductively-coupled device. The sensory region may include a pressure-activated switch, a light-sensing device, or a sound-sensing device.

The actuating system may move the first body portion relative to the second body portion in a direction towards the sensory region. The actuating system may move the first body portion relative to the second body portion in a direction away from the sensory region. The actuating system may move the first body portion relative to the second body portion by pivoting the first body portion relative to the second body portion about a pivot axis. The pivot axis may intersect the first and second body portions. The toy may further include a wheel region attached to the body to rotate about a wheel axis, a second motor within the body, and a second actuating system coupled to the second motor and to the wheel region to move the body in a direction that is perpendicular to the wheel axis.

Aspects of the toy can include one or more of the following advantages. For example, the animation of the head region and the actuation of the steering system are controlled by a single motor. Such a design reduces manufacturing costs and imparts a realism to the toy. The toy also may perform more realistically by reacting to a sensed input from a user by moving towards or away from the sensed input. Lastly, when the toy is in the form of a dog or domestic animal, the combined motion of the tail and the back region imparts further realism to the toy.

Other features will be apparent from the description, the drawings, and the claims.

DESCRIPTION OF DRAWINGS

Like reference symbols in the various drawings indicate like elements.

DETAILED DESCRIPTION

Figure 1:
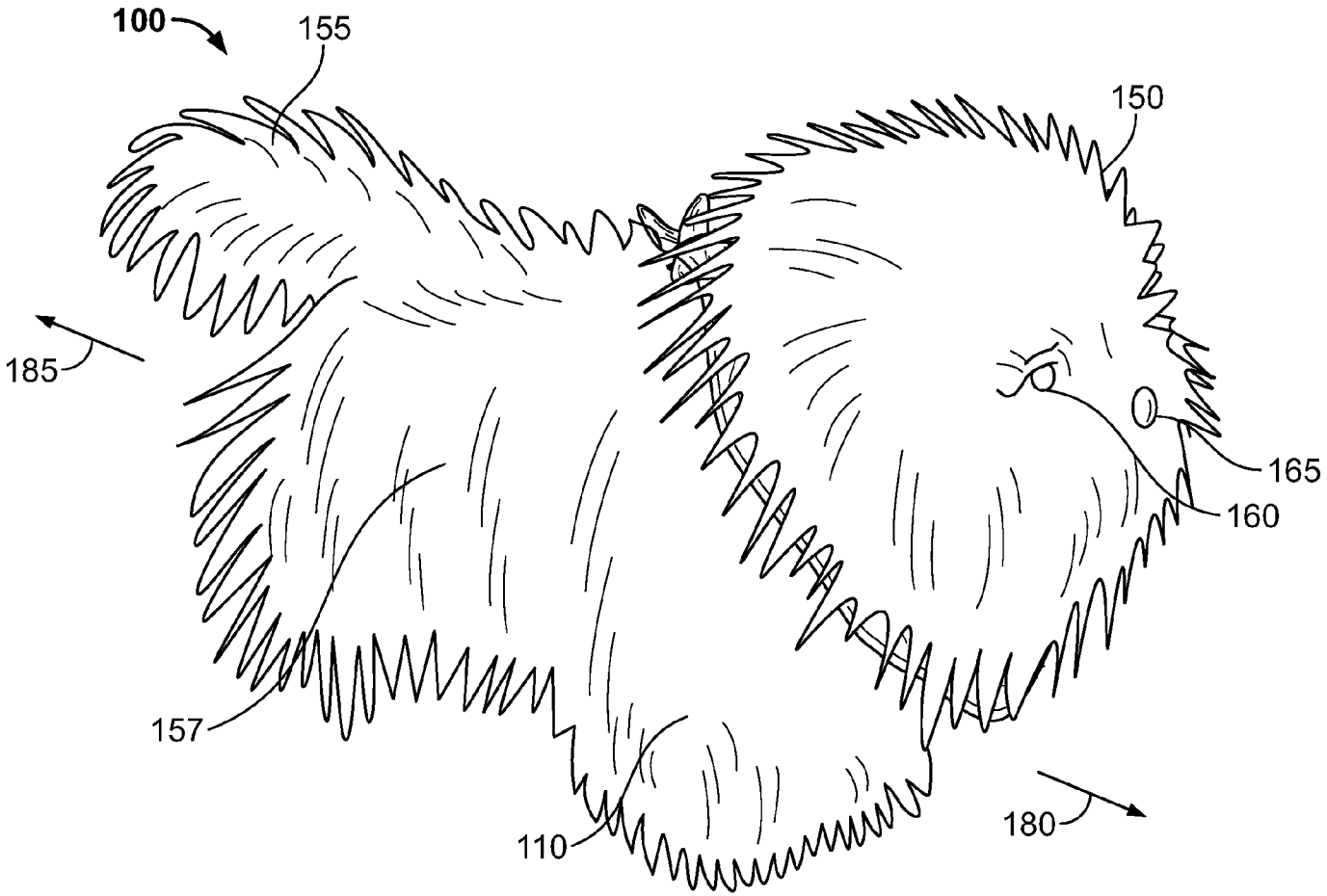
FIG. 1 is a perspective view of a toy.

Referring to FIGS. 1–4, a toy 100 is designed to resemble a dog and to provide realistic movement in response to a sensed condition. To this end, the toy 100 has an internal assembly 105 of interconnected parts surrounded by a flexible skin 110. The movements of the internal assembly 105 in response to sensed conditions, in combination with the manner in which the flexible skin 10 is attached to the internal assemble 105, permits the toy 100 to mimic the appearance and mannerisms of a dog in a strikingly realistic manner.

The internal assembly 105 includes a set of moveable regions coupled to a body 115. The moveable regions include one or more wheel regions 120, a back region 125, a head region 130, and side regions 135. The interconnected parts of the internal assembly 105 may be made of any suitable combination of materials, such as, for example, plastic and metal.

The internal assembly 105 also includes a set of input regions coupled to the body 115. The input regions include a sensory region 140 within the head region 130, a sensory region 145 within the back region 125, and sensory regions 147 on a side of the body 115. The sensory regions 140, 145, and 147 each include pressure sensitive switches that actuate an underlying button switch within the body 115 when a user touches the toy 100 at a location 150, 155, or 157 (FIG. 1) near the respective sensory region 140, 145, or 147.

The flexible skin 110 is shaped to fit over and mate with the internal assembly 105. Features, such as eyes 160 and a nose 165 snap into mating cavities of the skin 110 and the internal assembly 105. The flexible skin 110 may be made of a resilient material that is covered with one or more external soft layers, such as pile that resembles an animal's coat. As shown in FIG. 1, the toy 100 is in the shape of a dog and the flexible skin 110 resembles the coat of a dog.

Figure 5:
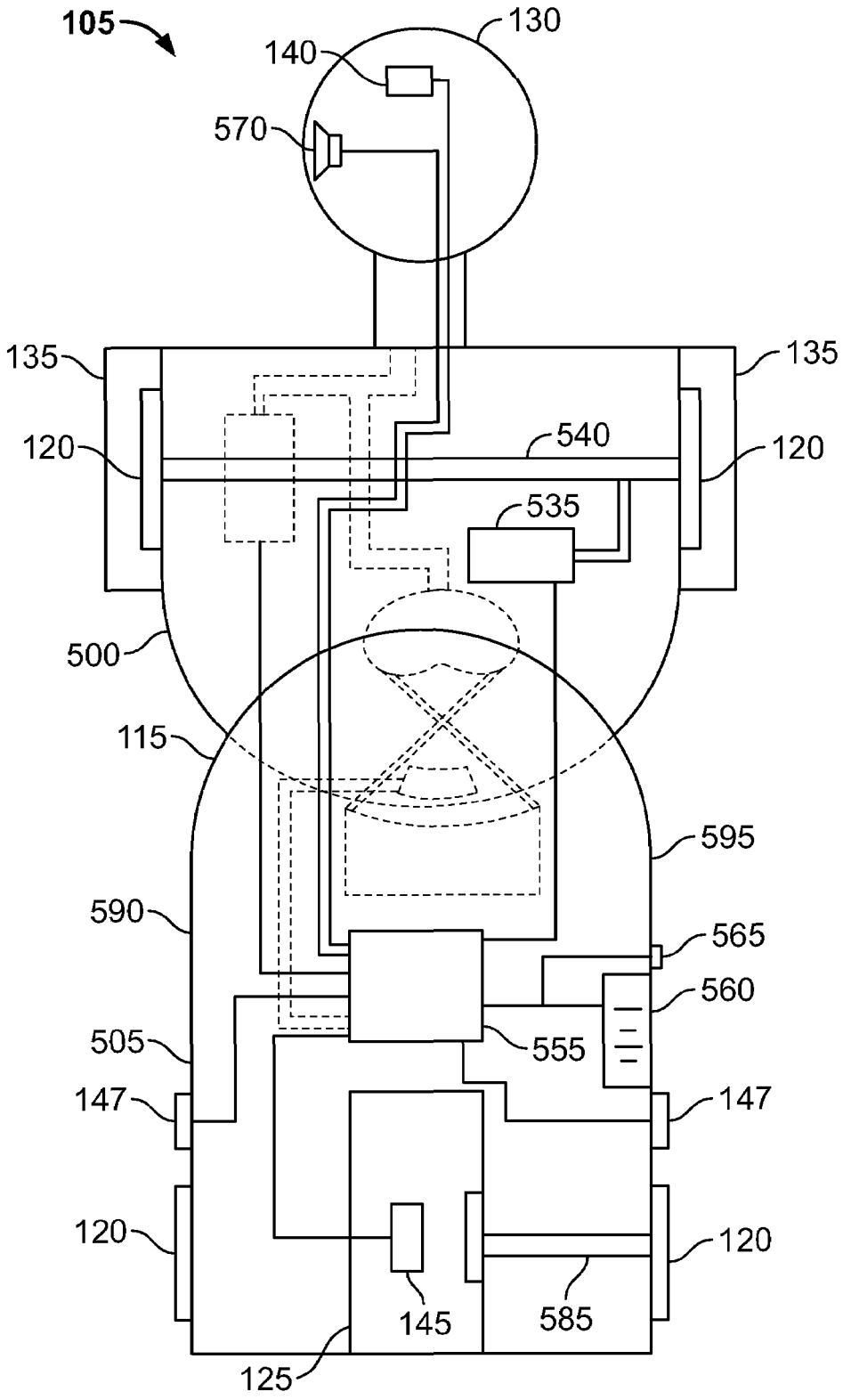
FIGS. 5 and 6 are block diagrams of the internal assembly of FIGS. 2–4.
Figure 6:
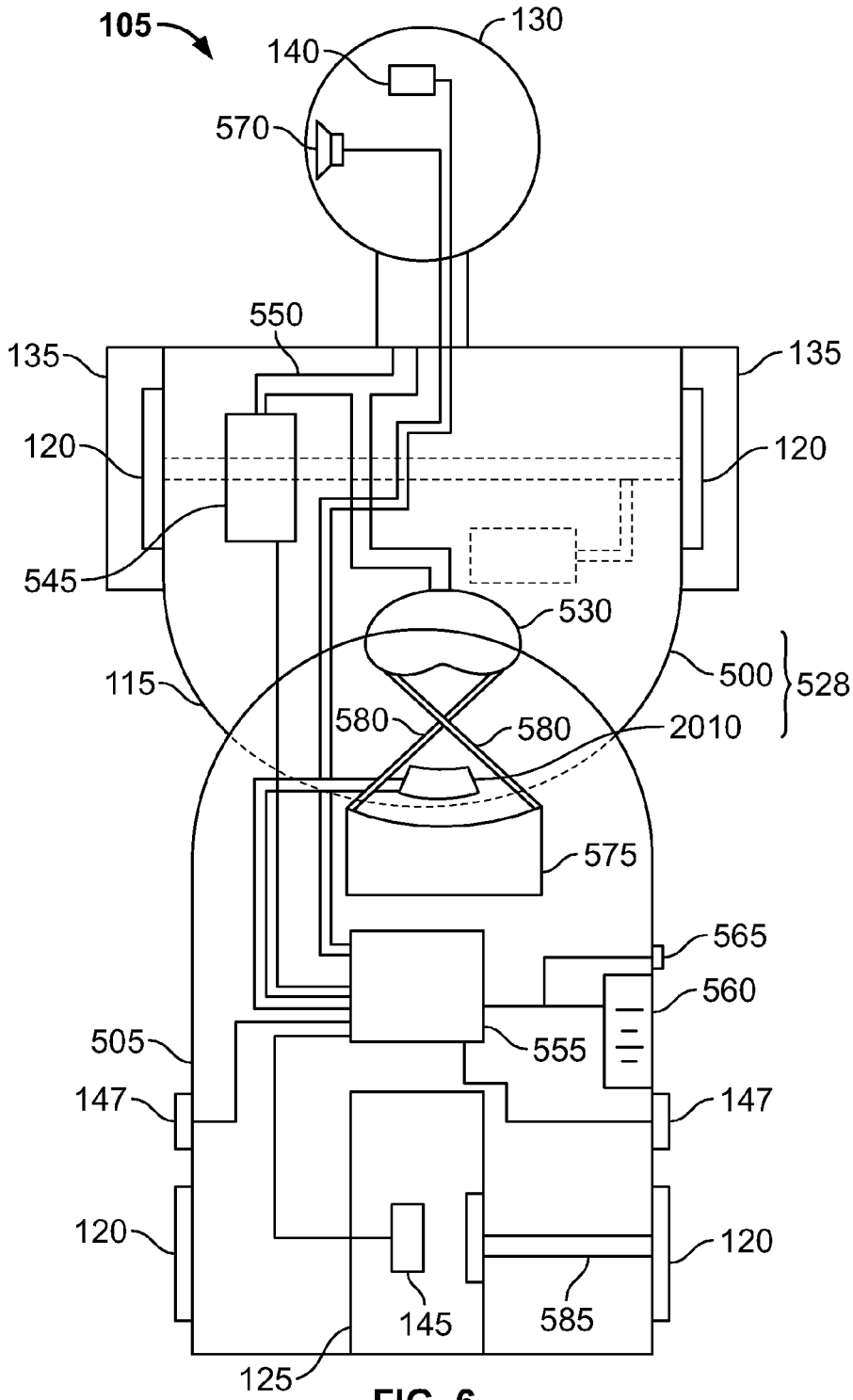
Figure 7:
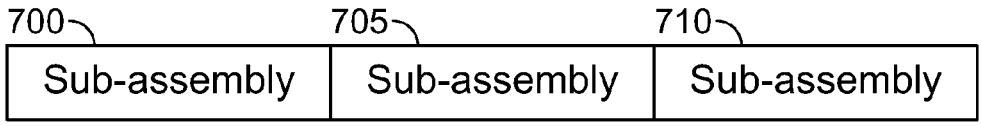
FIG. 7 is a block diagram showing the arrangement of sub-assemblies of the internal assembly of FIGS. 2–4.
Figure 8:
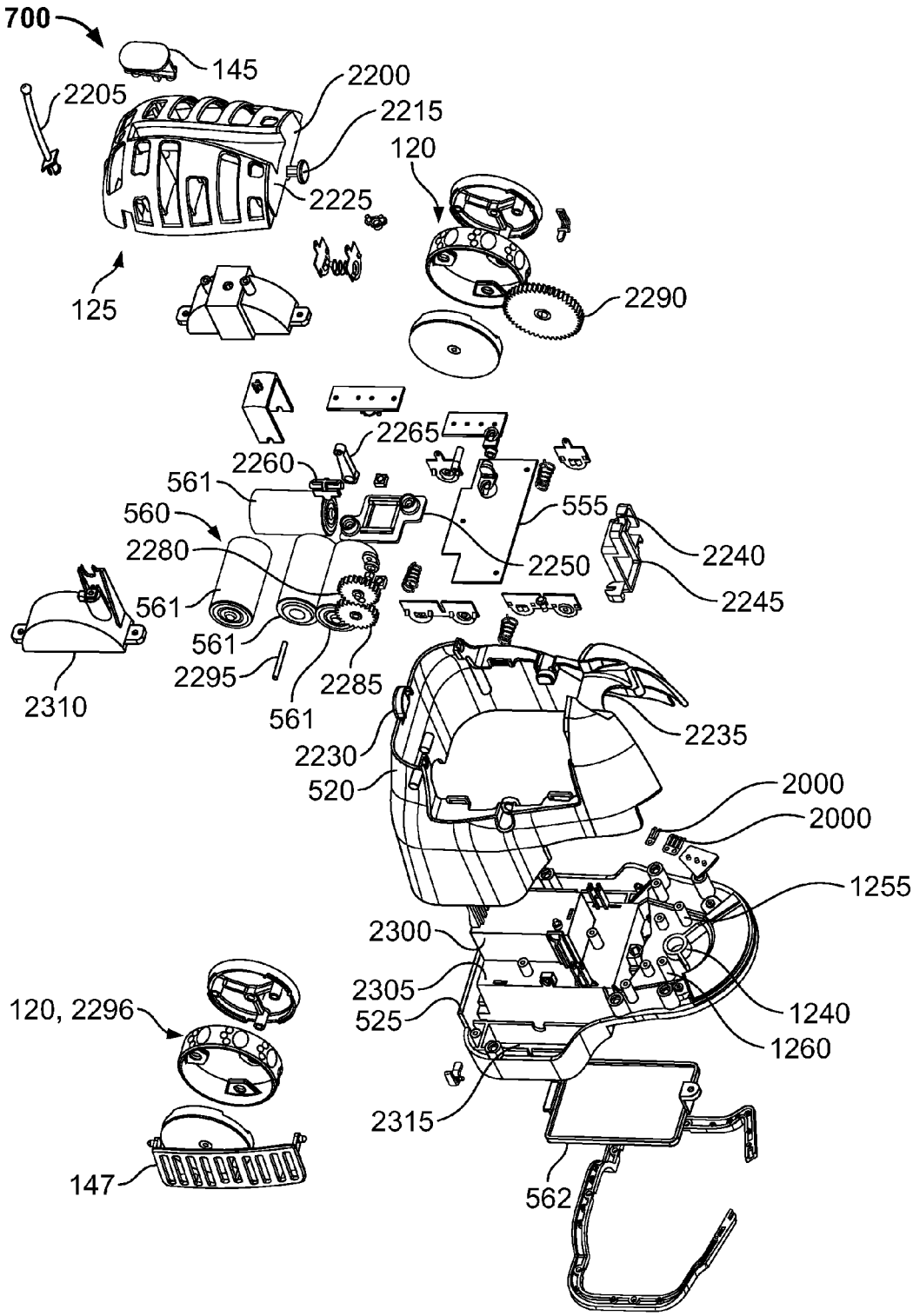
FIGS. 8–10 are exploded perspective views of the sub-assemblies of FIG. 7.
Figure 9:
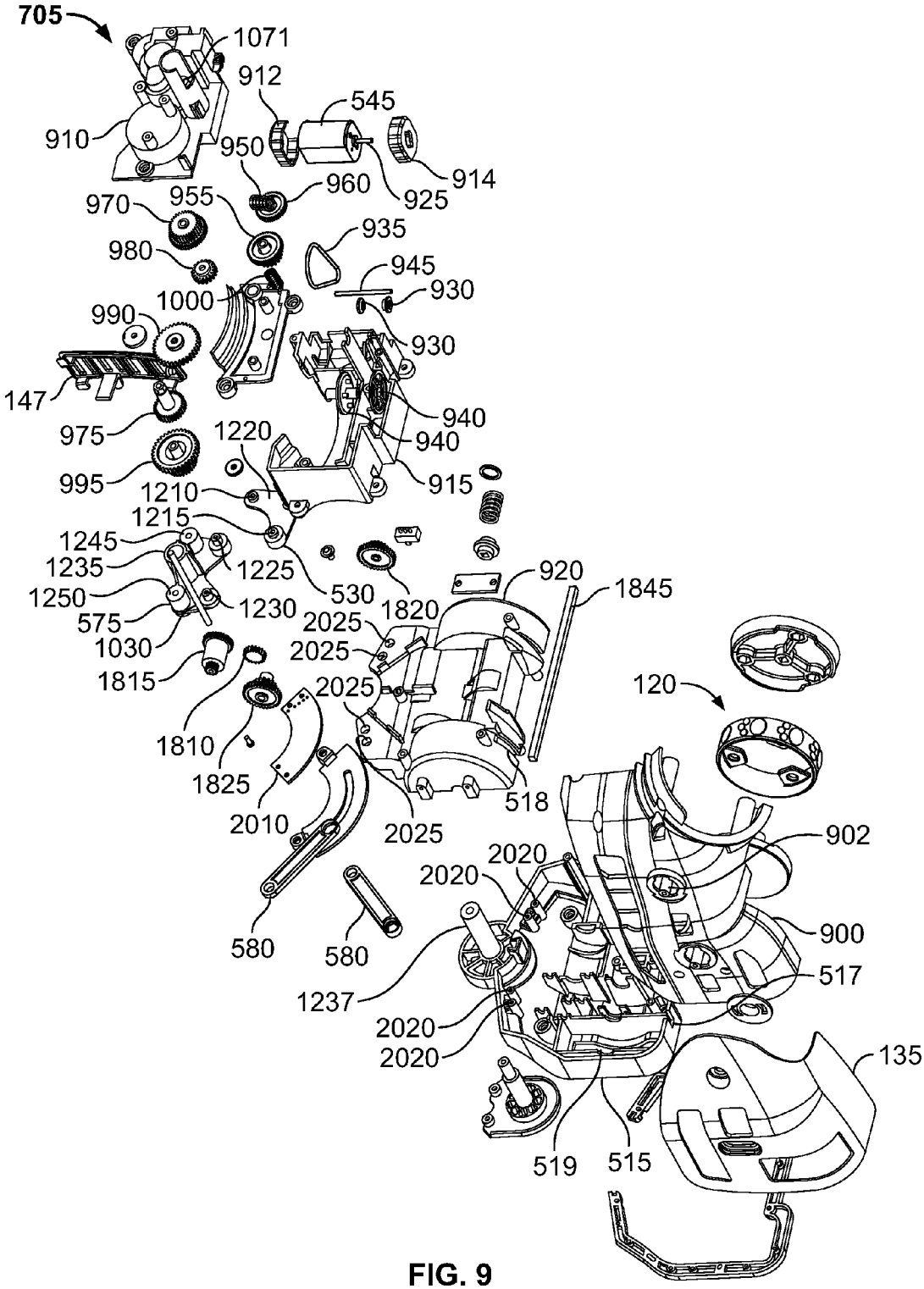
Figure 10:
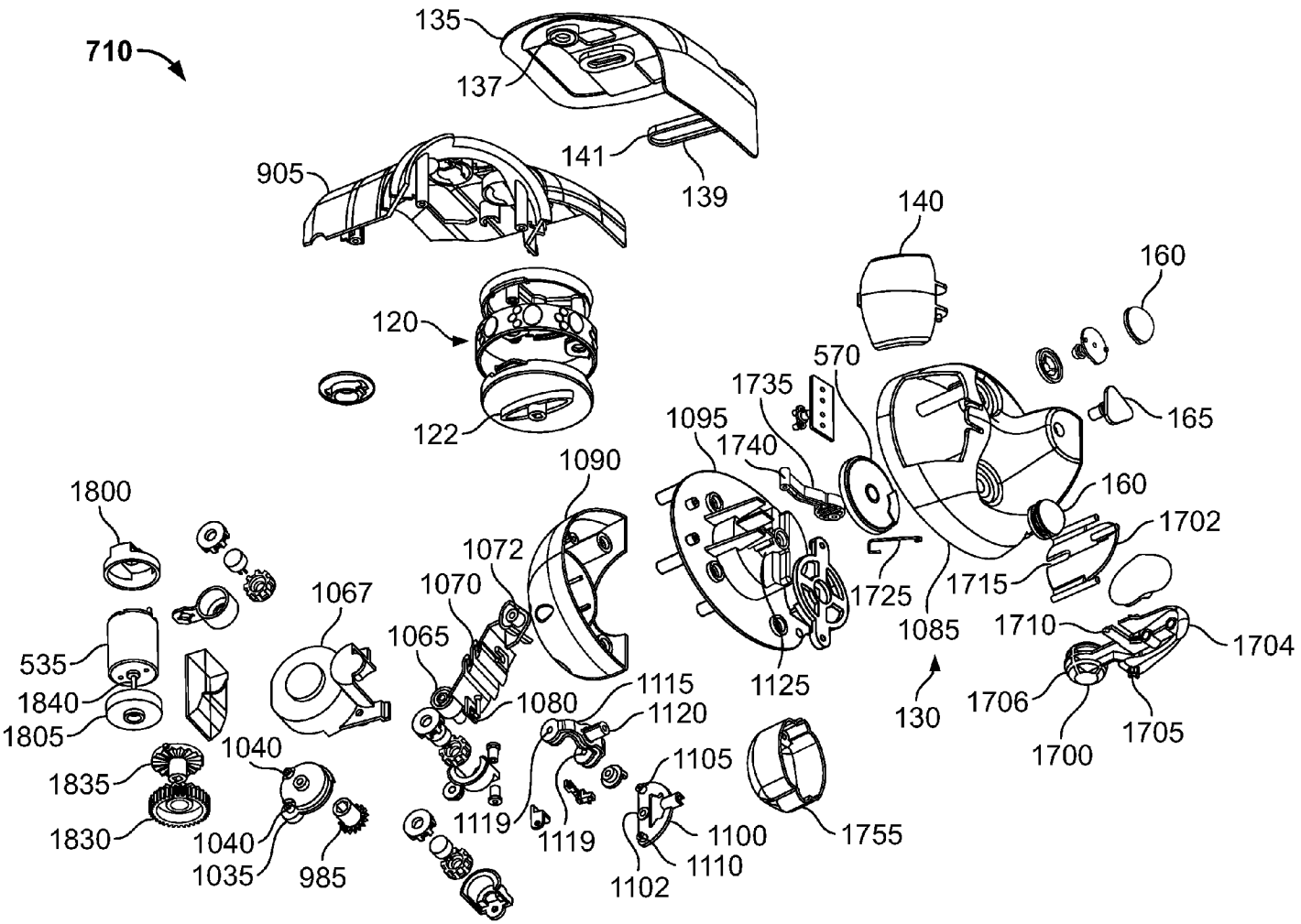

Referring also to FIGS. 5–16, the body 115 of the toy 100 houses components that control operation of the toy 100. FIGS. 5 and 6 show identical components, but to facilitate clarity, some components are shown with dashed lines in FIG. 5 while other components are shown with dashed lines in FIG. 6. FIG. 7 is an overview block diagram showing the general arrangement of sub-assemblies 700, 705, and 710 of the internal assembly 105. FIGS. 8–10 show exploded views of the sub-assemblies 700, 705, and 710, respectively.

Figure 2:
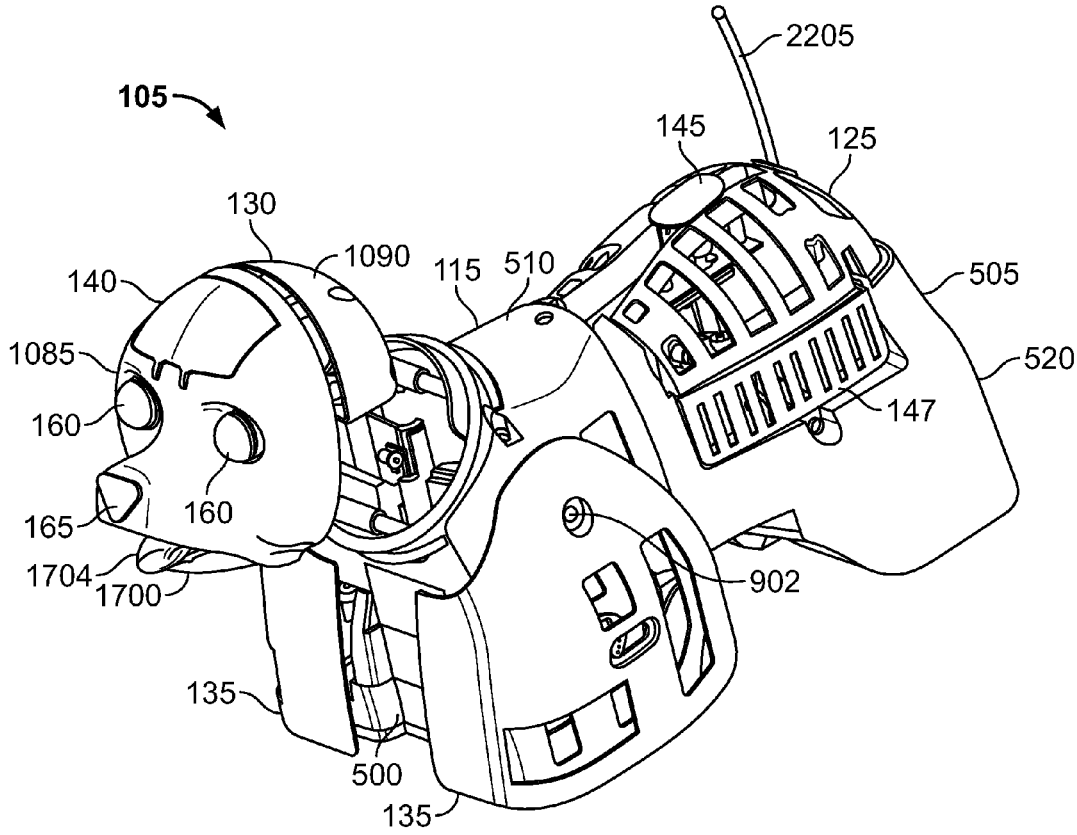
FIGS. 2–4 are perspective views of an internal assembly of the toy of FIG. 1.
Figure 3:
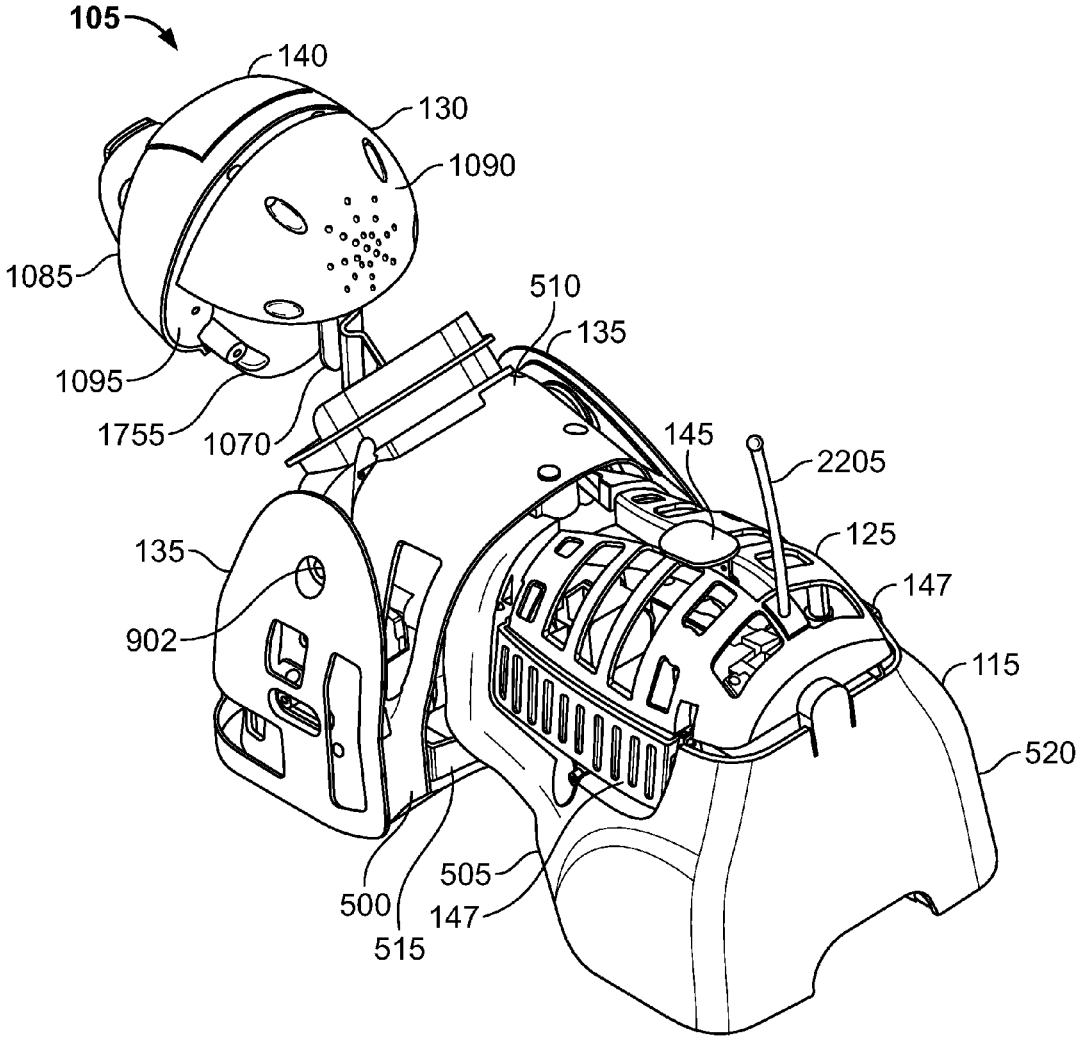
Figure 4:
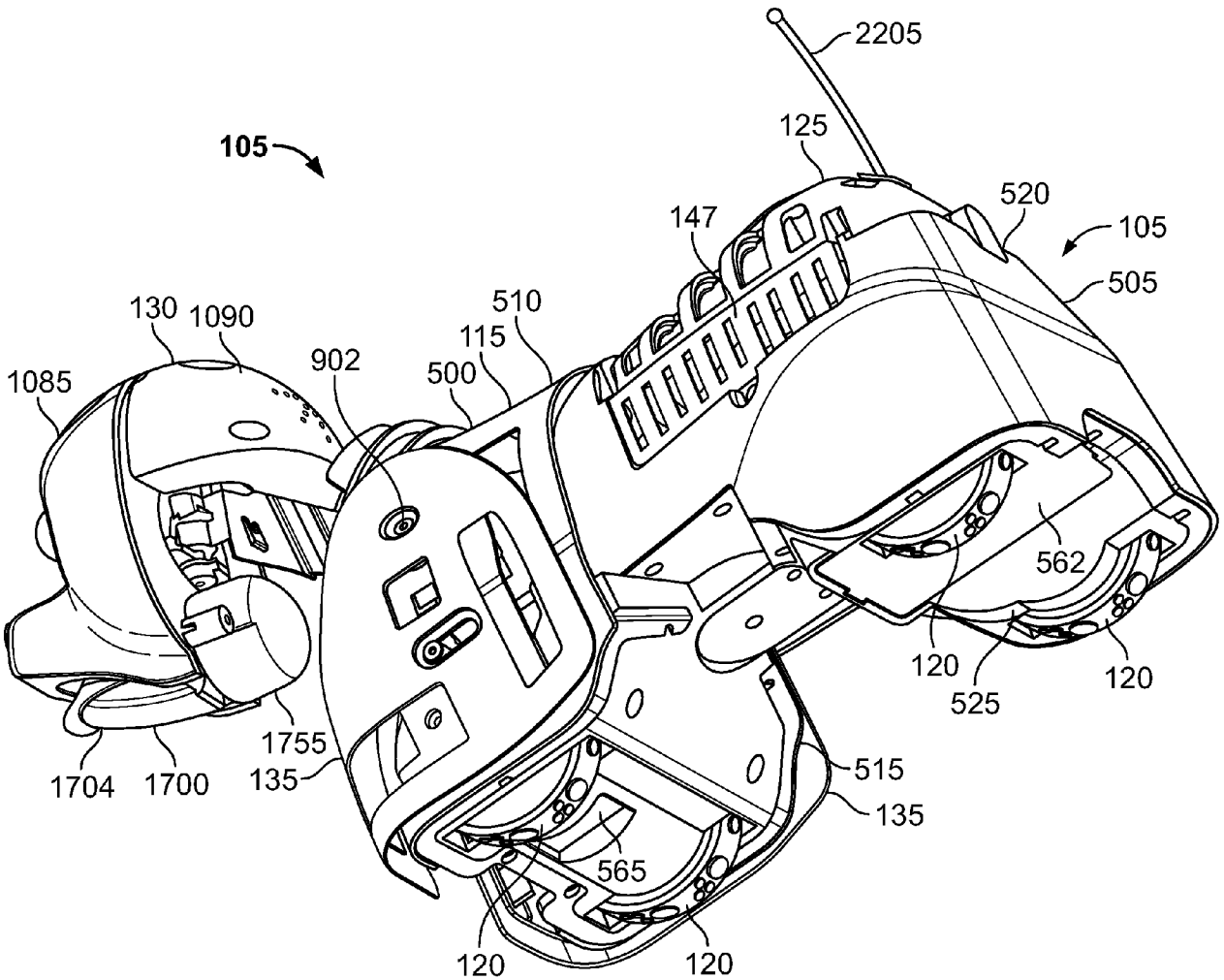

As shown in FIGS. 5 and 6, the body 115 includes a first body portion 500 and a second body portion 505. The first body portion 500 includes a first body panel 510 connected to a first base 515 (as shown in FIGS. 2–4). The first body panel 510 includes body panel pieces 900 and 905 (as shown in FIGS. 9 and 10) that mate to protect the components housed within the first body portion 500.

As also shown in FIGS. 5 and 6, two of the wheel regions 120 and the head region 130 connect to the first base 515 of the first body portion 500. Additionally, the side regions 135 attach to the first body panel 510 of the first body portion 500. The second body portion 505 includes a second body panel 520 connected to a second base 525 (as shown in FIGS. 2–4 and 8). Two of the wheel regions 120 connect to the second base 525, and the back region 125 attaches to the second body panel 520. The second body panel 520 houses the sensory regions 147, which are positioned below the back region 125.

As also shown in FIGS. 5 and 6, the first body portion 500 houses a first motor 535 coupled to a first actuation system 540 and a second motor 545 coupled to a second actuation system 550. The first actuation system 540 is coupled to the two wheel regions 120 that are connected to the first base 515. The second actuation system 550 is coupled to the head region 130 and to a steering system 528 (discussed below).

As also shown in FIGS. 5 and 6, the second body portion 505 houses internal control circuitry 555 and an energy source 560 that supplies power to the circuitry 555. The energy source 560 may be provided by batteries 561 (shown in FIG. 8) that are placed within a compartment 562 (shown in FIG. 4) on a lower side of the second base 525. The internal control circuitry 555 is turned off and on by a switch 565 (shown in FIG. 4) that is accessible from the first base 515. The internal control circuitry 555 is connected to an audio device 570 housed within the head region 130. The internal control circuitry 555 includes one or more of a processor or a controller, passive and active electronic components, and memory.

As also shown in FIGS. 5 and 6, the second body portion 505 also houses a third actuation system 585 that couples the back region 125 to the two wheel regions 120 that are connected to the second base 525.

As shown in FIG. 6, the body 115 houses the steering system 528, which is formed from several components attached to the first and second bases 515 and 525. The steering system 528 includes a steering bar 530 (shown in FIG. 9) that is housed within the first body portion 500 and is fixed to the first base 515. The steering system 528 also includes a hinge device 575 (shown in FIG. 9) housed within the second body portion 505 and fixed to the second base 525 of the second body portion 505. The hinge device 575 couples to the steering bar 530 through linkages 580 (shown in FIG. 9).

As shown in FIG. 9, the second motor 545 is mounted to a frame 910 with frame brackets 912 and 914. The frame 910 is attached to a frame base 915 that is attached to a wheel base 920. The wheel base 920 is attached to the first base 515. Attachment between pieces may be accomplished using any suitable technique, such as, for example, mating between screws on one piece and tapped holes on the other piece, snap or friction fit between the pieces, or adhesive attachment between the pieces.

As shown in FIGS. 9 and 14–16, the second actuation system 550 couples to a motor shaft 925 of the second motor 545. The second actuation system 550 includes a shaft pulley 930 fixed to the motor shaft 925, a drive belt 935, and a drive pulley 940 (shown also in FIGS. 11–13). The drive belt 935 frictionally engages the shaft pulley 930 and the drive pulley 940.

As shown in FIGS. 9 and 11–16, the second actuation system 550 includes a drive shaft 945, a worm gear 950 connected to the drive shaft 945, a set of gears 955, 960, 965, 970, 975, 980, 985, 990, and 995, and a spring 1000. Gear 955 includes a first set of gear teeth that couple to the worm gear 950 and a second set of gear teeth that couple to teeth on gear 960. Gear 960 is frictionally engaged with gear 965. For example, the gear 960 includes serrations that mate with serrations of the gear 965. Both of the gears 960 and 965 are supported on the frame base 915 by a shaft 1005.

Figure 14:
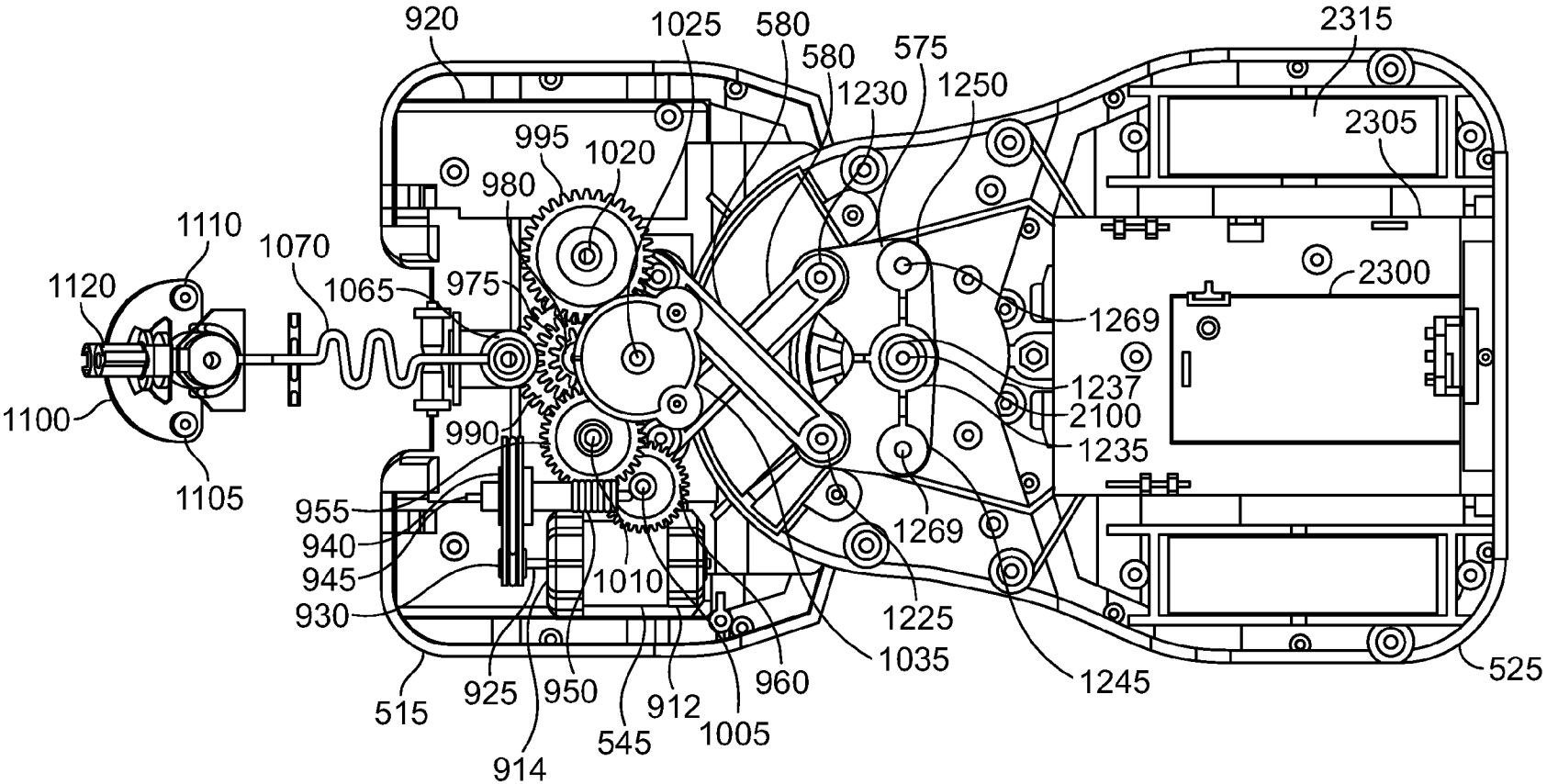
FIG. 14 is a top view of the internal assembly of FIGS. 2–4 with the body panels removed.
Figure 15:
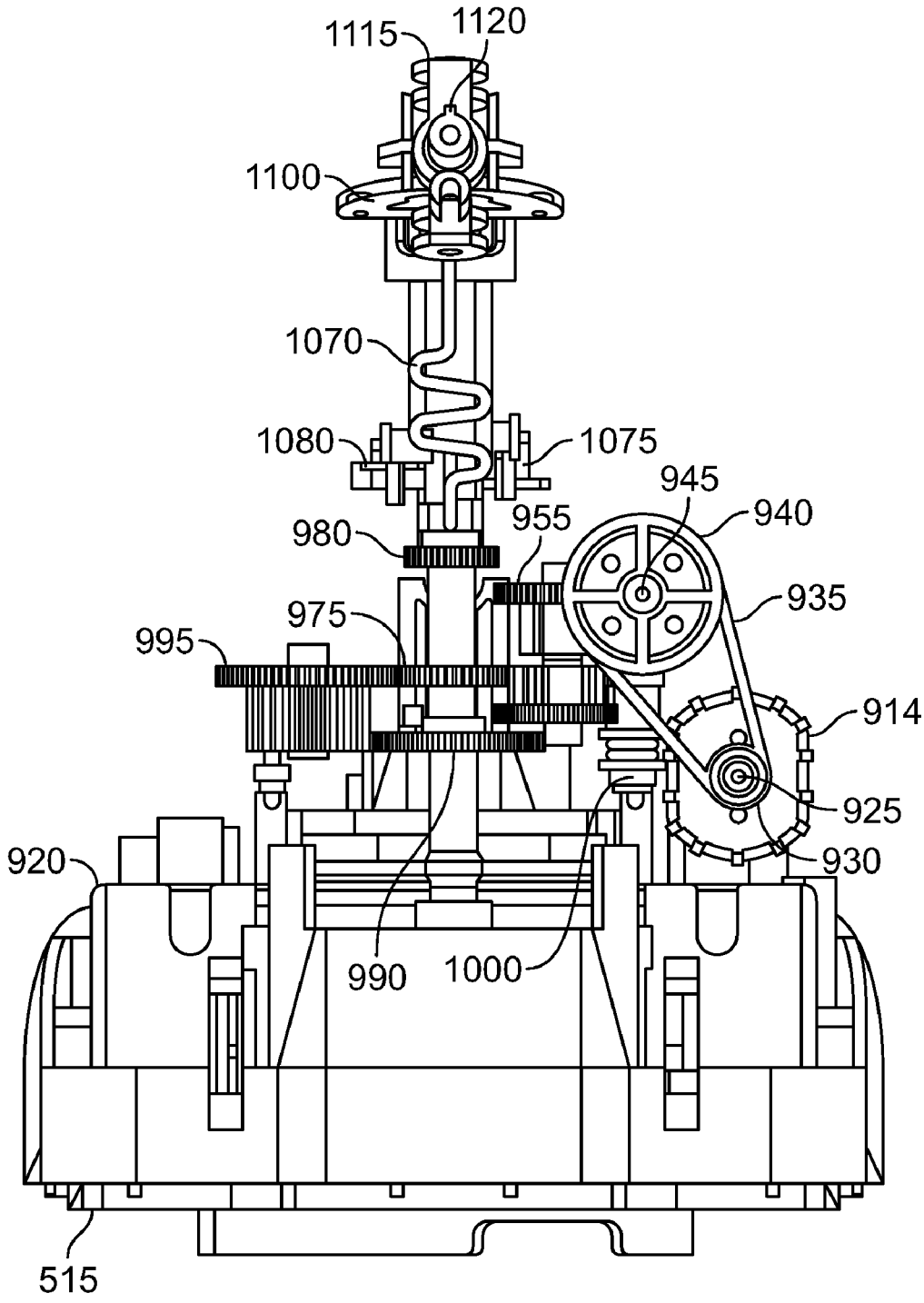
FIG. 15 is a front view of the internal assembly of FIGS. 2–4 with the body panels removed.

Gear 965 couples to a first set of teeth on gear 970. Both of gears 970 and 955 are supported on the frame base 915 by a shaft 1010. Gear 975 is coupled to a second set of teeth on gear 970 and is frictionally engaged with gear 980. For example, gear 975 includes a hex head 1015 that mates with a hex socket (not shown) of the gear 980. The teeth on gear 980 couple with the teeth on gear 985. Gear 985 is supported on the frame 910 by a shaft 1025 (as shown in FIGS. 14 and 17).

The teeth on gear 975 couple with a first set of teeth on gear 995. The teeth on gear 990 couple with a second set of teeth on gear 995. Gear 995 is supported on the frame base 915 by a shaft 1020. Gears 980, 975, and 990 are supported on the frame base 915 by a shaft 1030, which is frictionally engaged with gear 990 to rotate as gear 990 is rotated.

Referring to FIGS. 9 and 11–17, the second actuation system 550 further includes a neck pulley 1035 supported on the frame 910 with the shaft 1025. The neck pulley 1035 is frictionally engaged with gear 985 and/or the shaft 1025 to rotate as gear 985 rotates.

Figure 17:
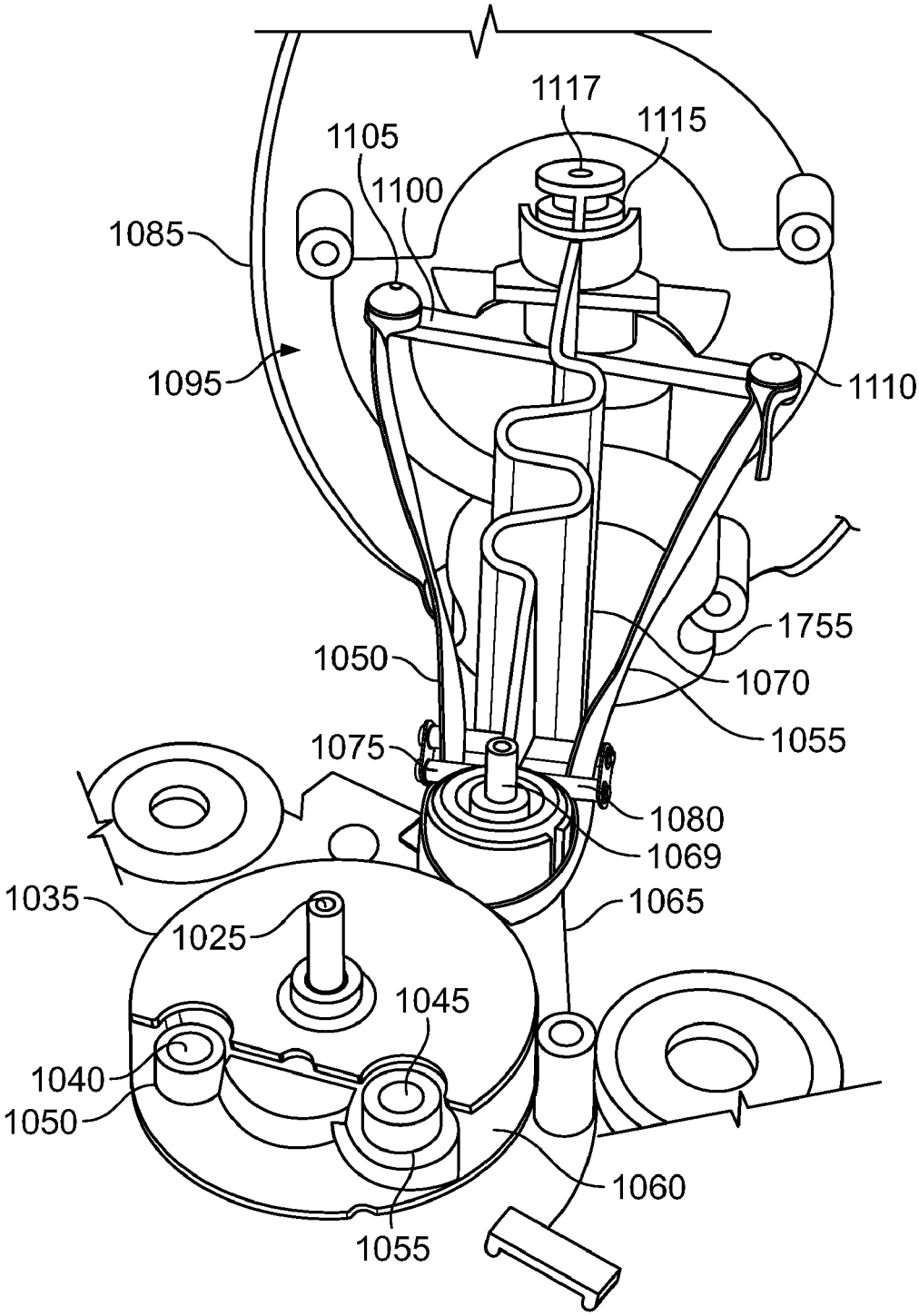
FIG. 17 is a perspective view of a portion of a head region of the internal assembly of FIGS. 2–4.

Referring in particular to FIG. 17, the neck pulley 1035 includes a pair of posts 1040 and 1045 that receive, respectively, elongated devices 1050 and 1055 that extend into the head region 130. The elongated devices 1050 and 1055 are made of any flexible material, such as, for example, string or fabric, that becomes slack in the absence of any tensioning or pulling force. The elongated devices 1050 and 1055 wrap around an outer circumference 1060 of the neck pulley 1035, intersect at a location on a side of the neck pulley 1035 opposite the posts 1040 and 1045, and wrap around a cylindrical post 1065 of the head region 130.

Referring also to FIG. 10, the first body portion 500 includes a protective plate 1067 that attaches to the frame 910 and covers the cylindrical post 1065, the neck pulley 1035, and the elongated devices 1050 and 1055.

As shown in FIGS. 10–17, the head region 130 includes a neck device 1070 that is integral with the cylindrical post 1065. The cylindrical post 1065 is configured to rotate about an axis 3100 (shown in FIGS. 31 and 32) that is defined by a shaft 1069 (shown in FIG. 17) that is fixed to a post 1071 (shown in FIG. 9) of the frame 910. The neck device 1070 includes guide members 1075 and 1080 (shown in FIGS. 10, 11, 16, and 17) that receive, respectively, the elongated devices 1050 and 1055.

The head region 130 includes a first rounded portion 1085 that mates with a second rounded portion 1090 and receives a plate 1095 that houses the audio device 570. The first rounded portion 1085 and the second rounded portion 1090 mate together to form a shape that resembles a head (FIGS. 2–4). The first rounded portion 1085 is configured to house the sensory region 140 and to receive the eyes 160 and the nose 165 (FIGS. 2–6 and 10).

Referring in particular to FIG. 17, the guide members 1075 and 1080 guide the elongated devices 1050 and 1055 from the neck pulley 1035 along sides of the neck device 1070, and to a tilt lever 1100 (shown also in FIG. 10) housed within the first rounded portion 1085. The elongated devices 1050 and 1055 are secured to, respectively, posts 1105 and 1110 on the tilt lever 1100. The tilt lever 1100 and the neck device 1070 are attached to a pivot device 1115 (shown also in FIGS. 10 and 12–16). In particular, the tilt lever 1100 includes a hole 1102 (shown in FIGS. 10 and 12) and the neck device 1070 includes a hole 1072 (shown in FIGS. 10 and 12). The holes 1072 and 1102 receive a shaft 1117 (shown in FIGS. 16 and 17). The shaft 1117 passes through holes 1119 of the pivot device 1115 (shown in FIGS. 10 and 12). The tilt lever 1100 and the neck device 1070 are free to rotate about an axis 3117 (shown in FIGS. 31 and 32) defined by the shaft 1117 of the pivot device 1115. The axis 3117 is approximately parallel to the axis 3100.

As shown in FIGS. 10 and 12–16, the pivot device 1115 includes a post 1120 that mates with a post 1125 (FIG. 10) of the plate 1095. In this way, the pivot device 1115 and the plate 1095 are able to rotate freely about an axis 3125 (shown in FIGS. 31 and 32) extending along the longitudinal length of the posts 1120 and 1125 relative to each other. In general, the axis 3125 is not parallel to the axis 3117. In one implementation, the axis 3125 is approximately perpendicular to the axis 3117.

Figure 18:
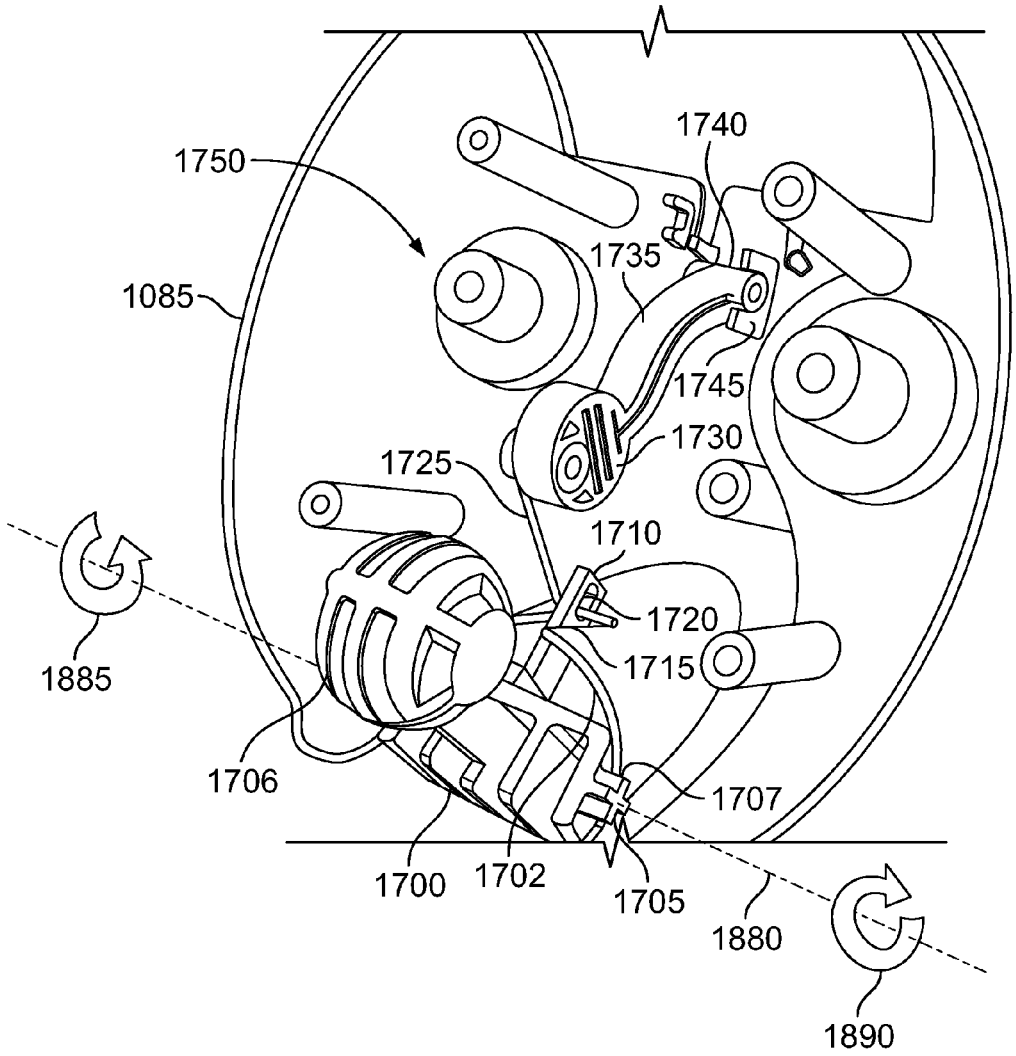
FIG. 18 is a perspective view of a portion of an interior of the head region of the internal assembly of FIGS. 2–4.

Referring again to FIGS. 10 and 17, and also to FIG. 18, the head region 130 includes a pivoting member 1700 that fits within a lower cavity formed from a raised panel 1702 of the first rounded portion 1085. The pivoting member 1700 fits through an opening of the plate 1095. The opening is sized to receive the pivoting member 1700 when the plate 1095 is attached to the first rounded portion 1085.

As shown in FIG. 18, the pivoting member 1700 has protrusions 1705 that mate with recesses 1707 within the raised panel 1702. The pivoting member 1700 is formed from a first piece 1704 and a second piece 1706. The first piece 1704 extends out of the first rounded portion 1085 from one side of the protrusions 1705, and the second piece 1706 extends from another side of the protrusions 1705. A catch device 1710 extends from the pivoting member 1700 and through a slot 1715 (shown also in FIG. 10) within the raised panel 1702 when the pivoting member 1700 is inserted into the cavity of the raised panel 1702 (as shown in FIG. 18).

As shown in FIG. 18, the catch device 1710 defines a catch slot 1720 that receives a first end of a connector 1725. A second end of the connector 1725 is rotatably fixed to a lower end 1730 of a pendulum 1735. The pendulum 1735 includes a pivot bar 1740 that fits within a cylindrical depression 1745 on the inside surface 1750 of the first rounded portion 1085. The pivot bar 1740 is free to rotate about its longitudinal axis so that the lower end 1730 of the pendulum 1735 is free to rotate.

Referring to FIGS. 3, 4, 10, and 17, to protect the pivoting member 1700, the head region 130 includes a cover 1755 that attaches to a back side of the plate 1095 and covers the portion of the pivoting member 1700 that is received within the opening of the plate 1095.

Figure 11:
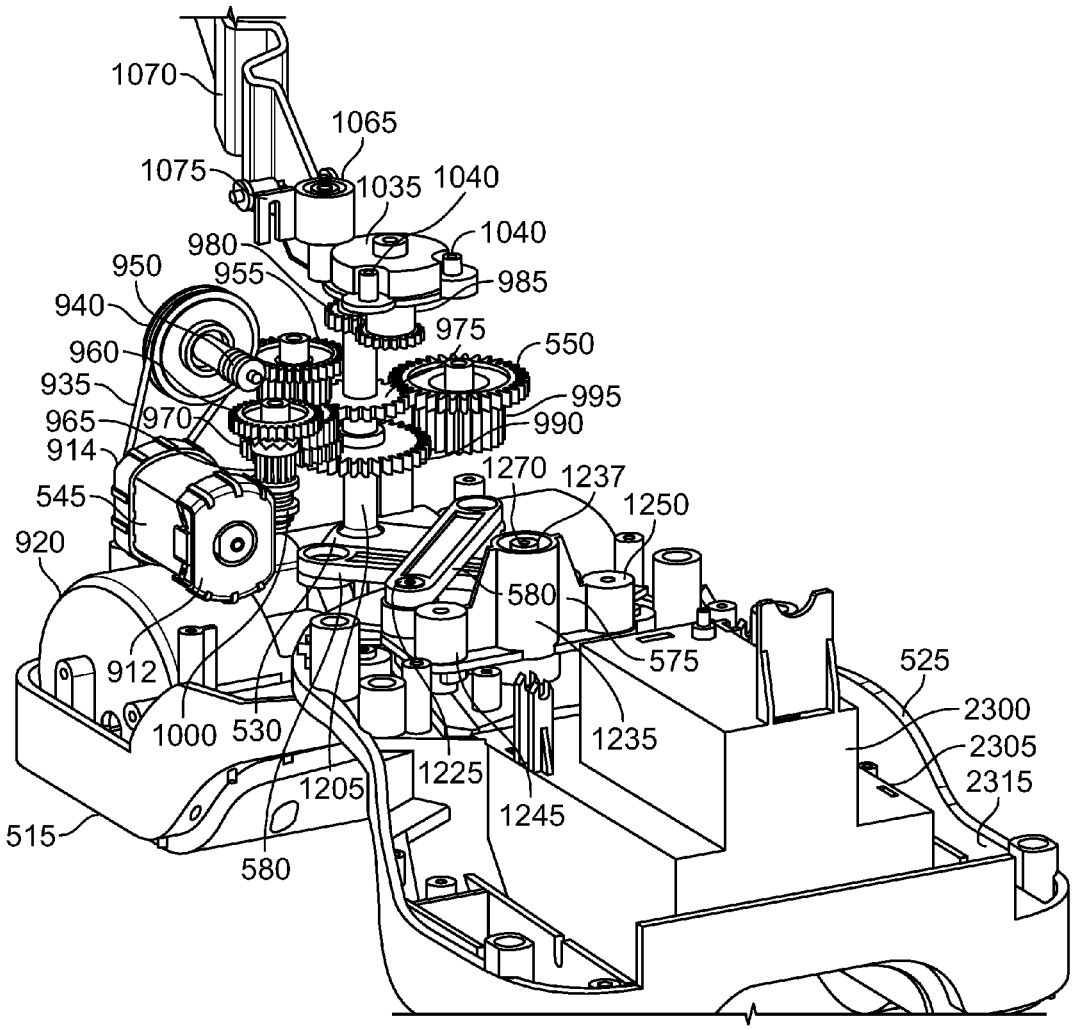
FIGS. 11 and 13 are perspective views of the internal assembly of FIGS. 2–4 with body panels removed.
Figure 12:
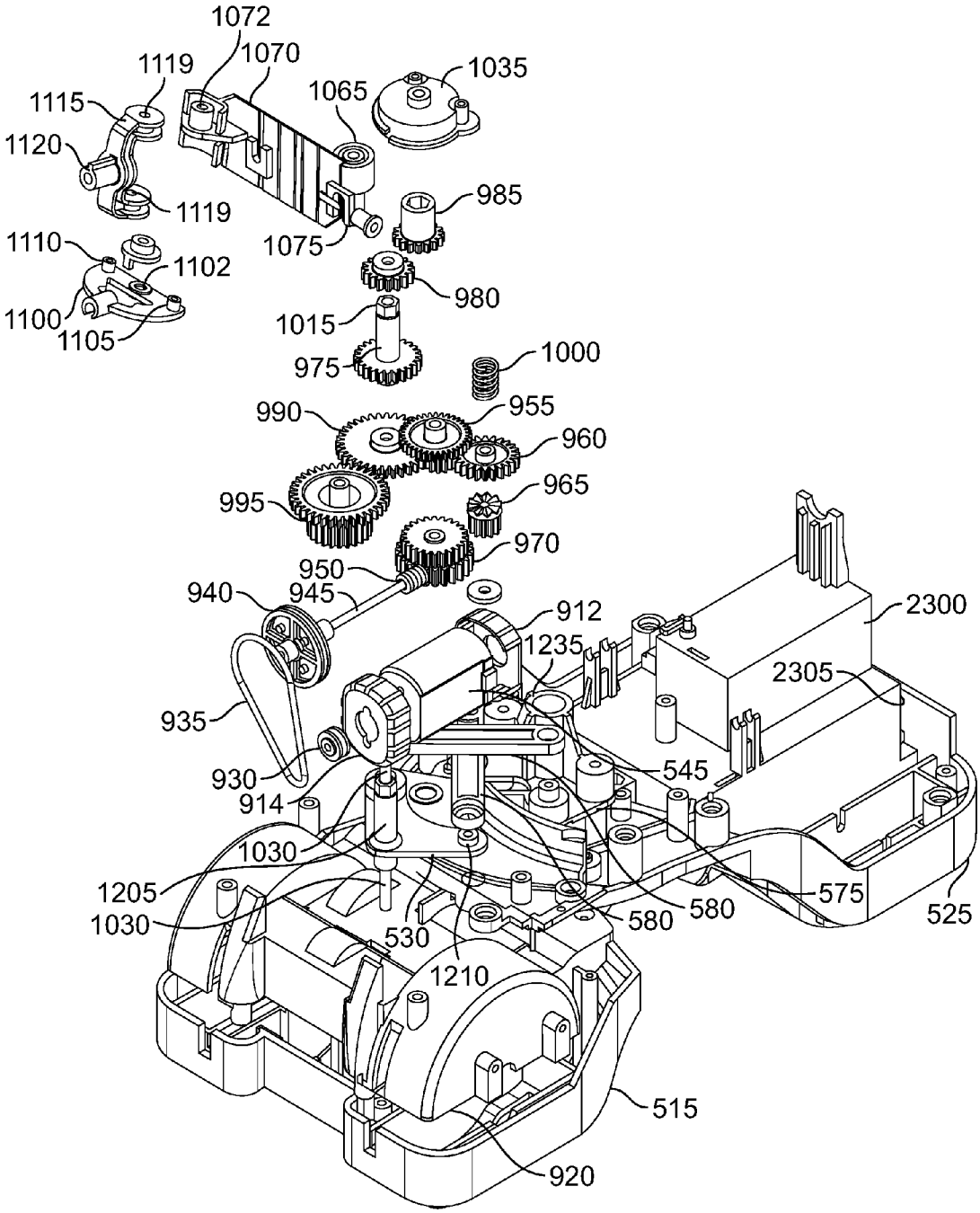
FIG. 12 is an exploded perspective view of the internal assembly of FIGS. 2–4 with the body panels removed.
Figure 13:
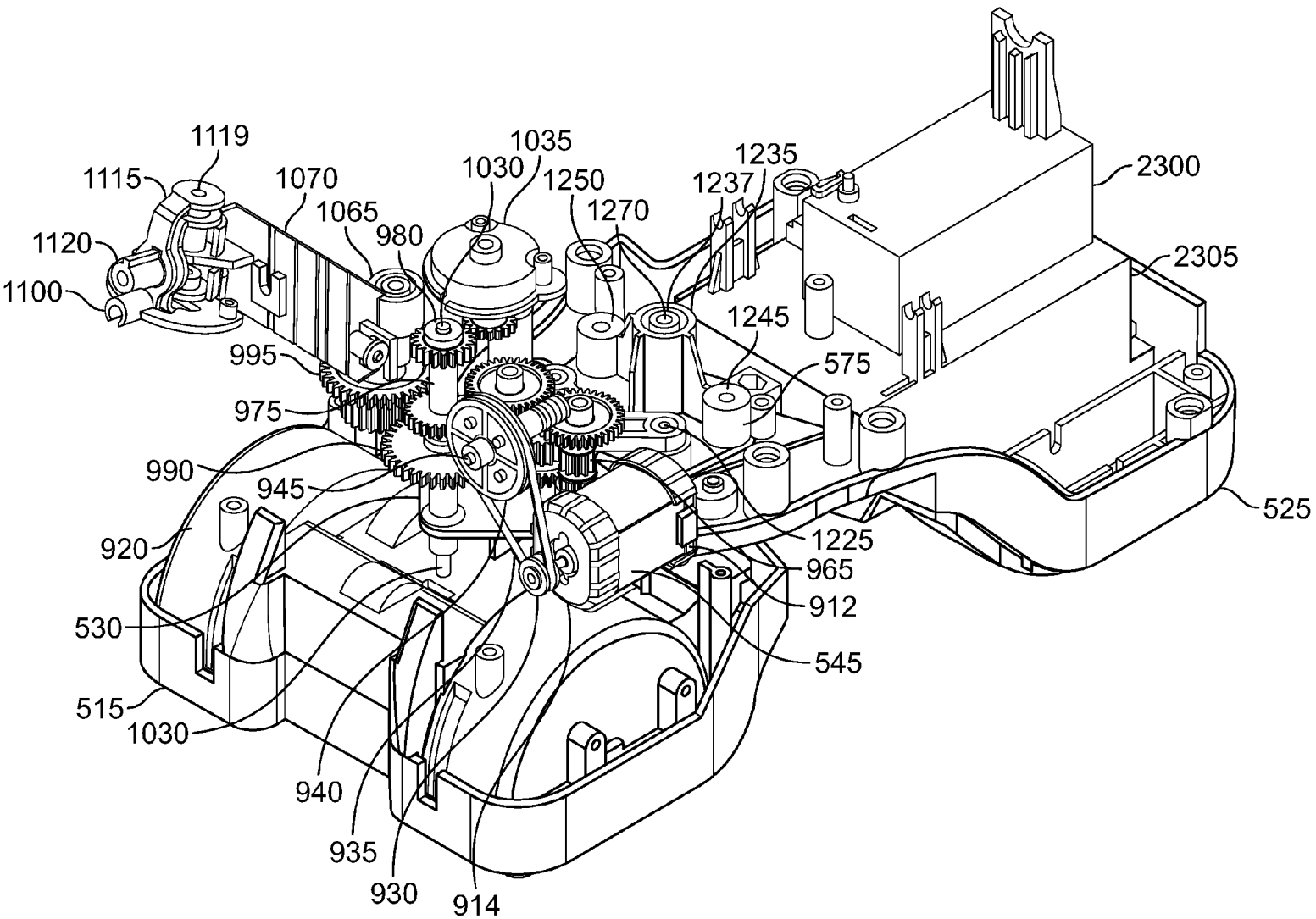

With reference again to FIGS. 9, 12, 13, and 16, gears 980, 975, and 990 are supported on the frame base 915 by the shaft 1030, which is frictionally engaged with gear 990 to rotate as gear 990 is rotated. As shown in FIGS. 11 and 12, the shaft 1030 is frictionally engaged with a post 1205 that is attached to or integral with the steering bar 530. In this way, the steering bar 530 rotates as the shaft 1030 rotates. The steering bar 530 includes posts 1210 and 1215 that extend from a plane 1220 of the steering bar 530 (shown in FIGS. 9 and 12).

Referring to FIGS. 9, 11–14, and 16, first ends of the linkages 580 connect to the posts 1210 and 1215 and second ends of the linkages 580 couple to posts 1225 and 1230 of the hinge device 575. As shown in FIGS. 9, 11, 13, 14, and 16, the hinge device 575 includes posts 1245 and 1250 that align with, respectively, threaded posts 1255 and 1260 (shown in FIG. 8) of the second base 525 when the hinge device 575 is placed on the second base 525. The hinge device 575 includes a post 1235 that aligns with a threaded post 1237 (shown in FIGS. 9 and 19) on the first base 515. The threaded post 1237 is received within a hole 1240 (shown in FIG. 8) of the second base 525 to join the first body portion 500 with the second body portion 505. The hinge device 575 is fixed to the second base 525 with screws 1269 (shown in FIG. 14) having threads that mate with respective threads of the posts 1255 and 1260. The second base 525 is fixed to the first base 515 with a screw 1270 (shown in FIG. 11) having threads that mate with threads of the post 1237.

Figure 19:
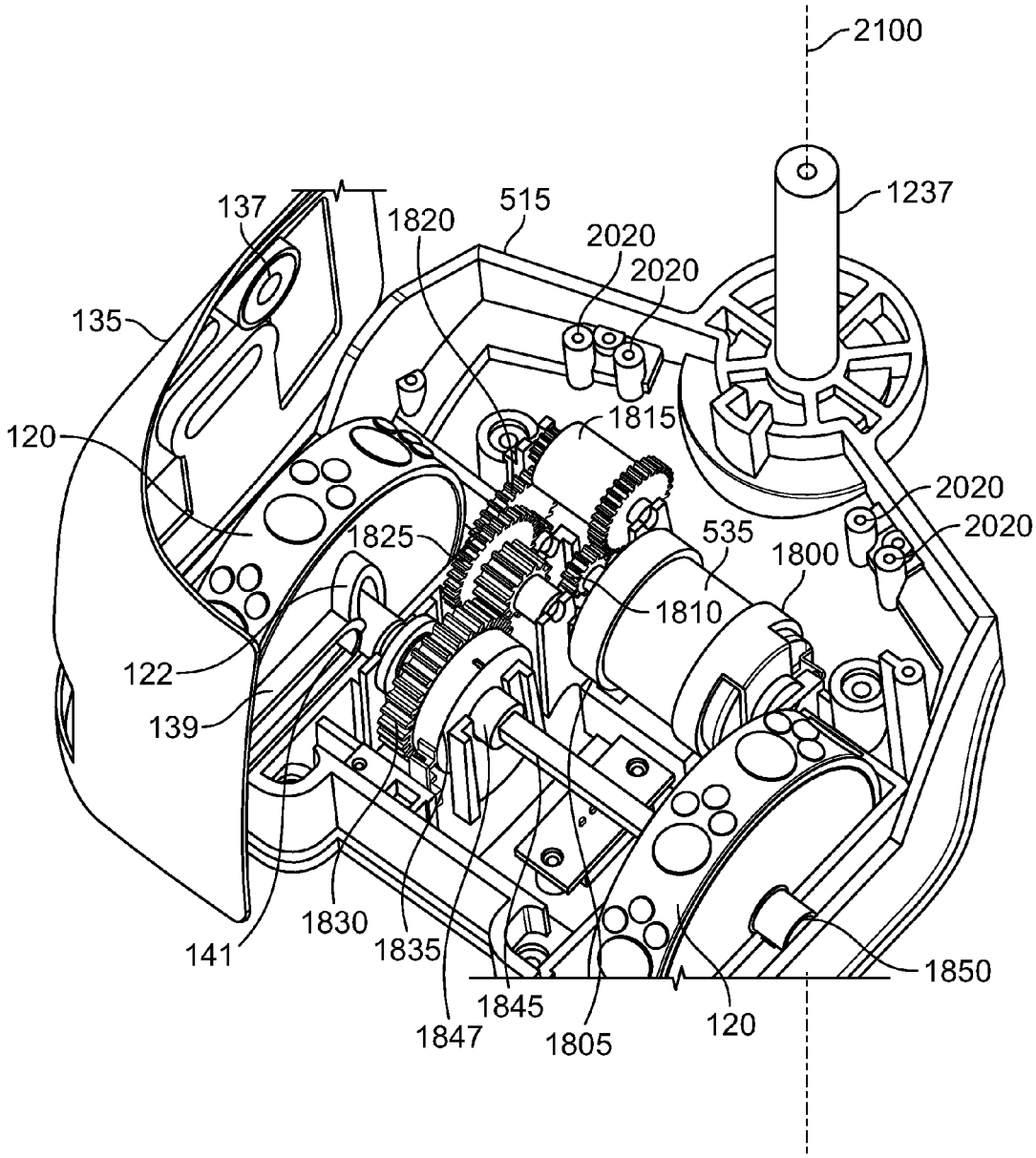
FIG. 19 is a perspective view of an interior of a first body portion of the internal assembly of FIGS. 2–4.
Figure 20:
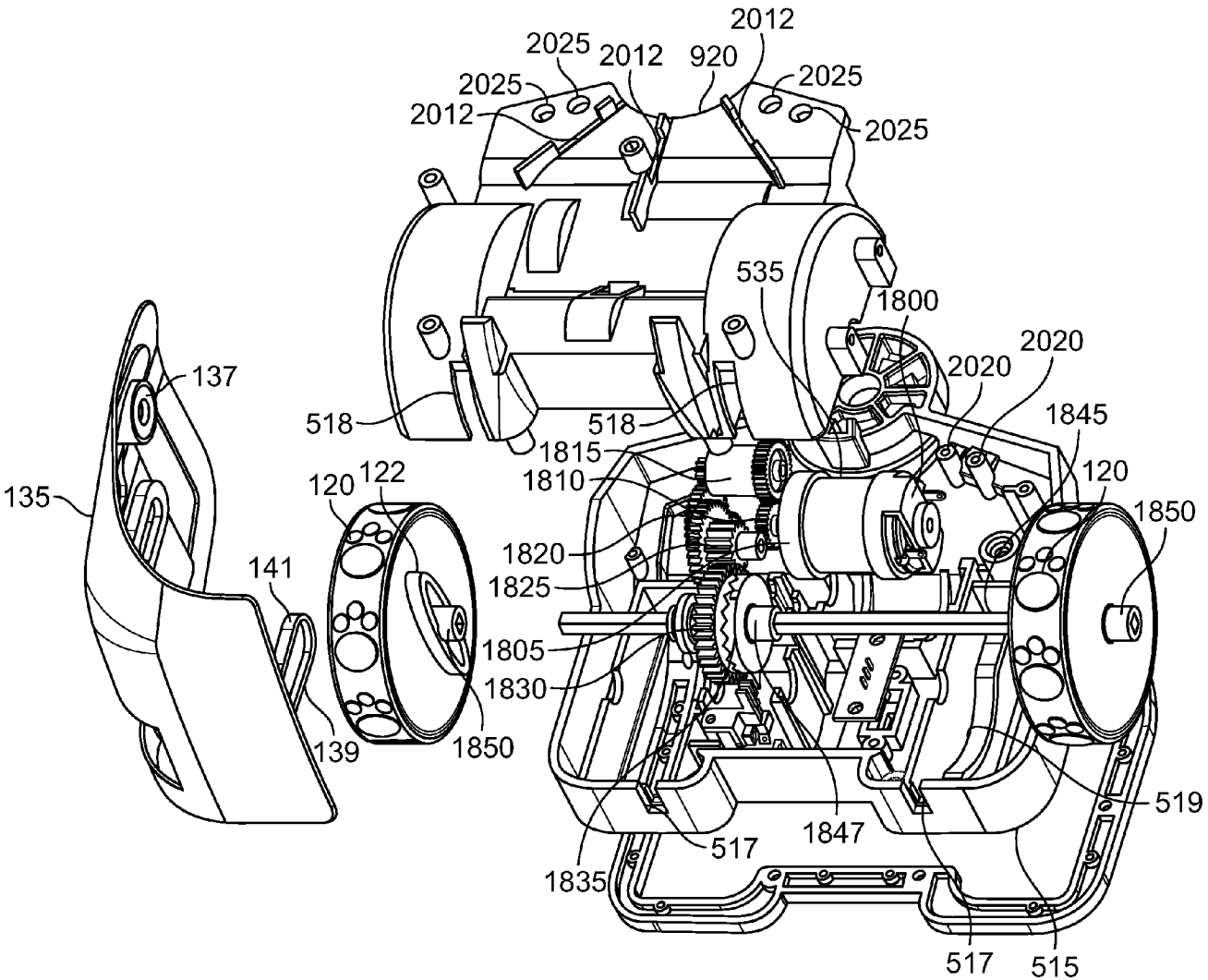
FIG. 20 is an exploded perspective view of an interior of the first body portion of the internal assembly of FIGS. 2–4.

Referring also to FIGS. 19 and 20, the first motor 535 is mounted to the first base 515 by base brackets 1800 and 1805 (shown also in FIG. 10). As also shown in FIG. 5, the first motor 535 connects with the first actuation system 540. The first actuation system 540 is mounted between the wheel base 920 and the first base 515 (shown also in FIG. 9).

With particular reference to FIGS. 9, 10, 19, and 20, the first actuation system 540 includes a set of gears 1810, 1815, 1820, 1825, and 1830, and a clutch 1835, that couple to a motor shaft 1840 (FIG. 10) of the first motor 535. The first actuation system 540 also includes an axle 1845 that couples to the two wheel regions 120 within the first body portion 500.

As shown in FIGS. 19 and 20, gear 1810 is mounted to the shaft 1840 to rotate as the shaft 1840 rotates. Teeth of gear 1810 engage a first set of teeth on gear 1815. A second set of teeth on gear 1815 engage a first set of teeth on gear 1820. A second set of teeth on gear 1820 engage a first set of teeth on gear 1825. A second set of teeth on gear 1825 engage teeth on gear 1830, which is fixed to the clutch 1835. The clutch 1835 is formed with a socket 1847 that mates with the axle 1845 such that, as the clutch 1835 rotates, the axle 1845 rotates. The axle 1845 mates with sockets 1850 of the wheel regions 120.

Referring to FIGS. 9, 10, 19, and 20, each of the side regions 135 includes a connector 137 formed on an inside surface of the side region 135. Each connector 137 mates with a connector 902 formed on an outside surface of the body panel piece 900 or 905. Each of the side regions 135 includes a protrusion 139 that is sized to fit within a slot 517 of the first base 515 and a slot 518 of the wheel base 920. The slot 518 mates with the slot 517 when the wheel base 920 is attached to the first base 515. The protrusion 139 is sized to extend through the slots 517 and 518, and into a wheel recess 519 that receives one of the front wheel regions 120. The protrusion 139 is formed with an edge 141 that engages a cam 122 of the front wheel region 120 when the side region 135 is attached to the body panel piece 900 or 905.

Figure 21:
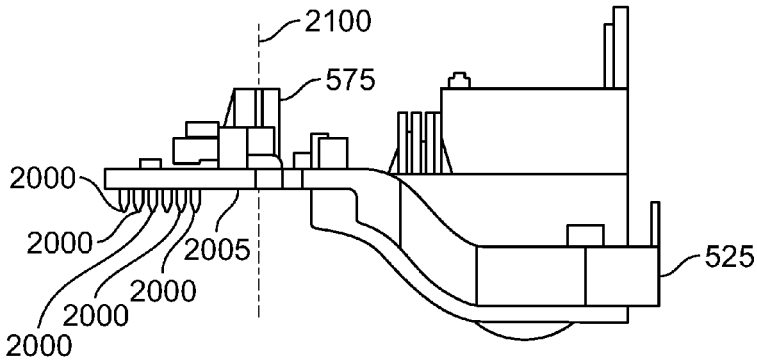
FIG. 21 is a side view of a second base of a second body portion of the internal assembly of FIGS. 2–4.
Figure 22:
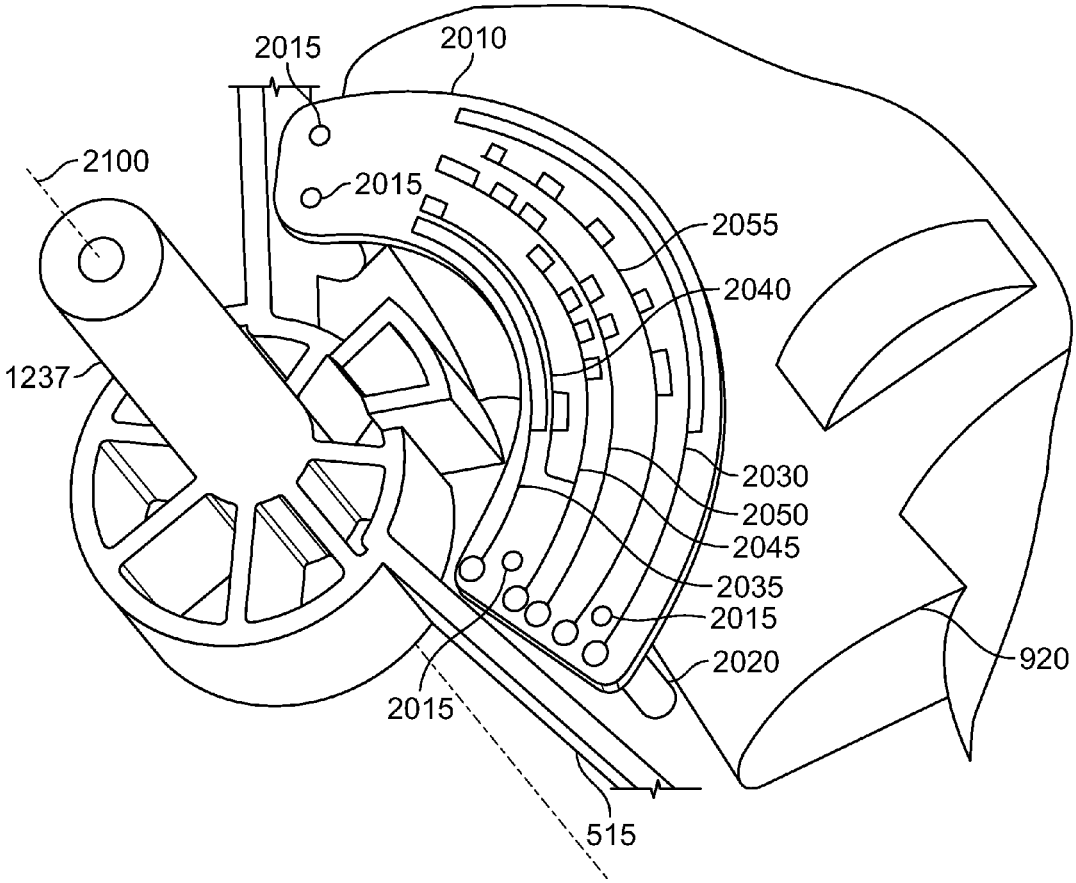
FIG. 22 is a perspective view of the interior of the first body portion of the internal assembly of FIGS. 2–4.

Referring to FIG. 21, the second base 525 of the second body portion 505 includes a set of conductive wipers 2000 that protrude from a lower surface 2005 of the second base 525. Referring to FIG. 22, the first body portion 500 houses a wiper contact 2010 that is mounted within grooves 2012 (shown in FIG. 20) of the wheel base 920. The wiper contact 2010 is secured to the first base 515 using screws 2015 that mate with posts 2020 of the first base 515 (shown also in FIG. 20). As shown in FIGS. 9, 19, and 20, the posts 2020 of the first base 515 protrude through aligned holes 2025 of the wheel base 920.

With reference to FIG. 22, the wiper contact 2010 includes electrically-conductive paths 2030–2055 that have different shapes and are spaced apart from each other by a distance equivalent to the distance separating each of the wipers 2000. When the first body portion 500 is joined with the second body portion 505, the wipers 2000 contact the paths 2030–2055. The paths 2030–2055 are electrically connected to the circuitry 555 by conductive and insulated wires.

Figure 23:
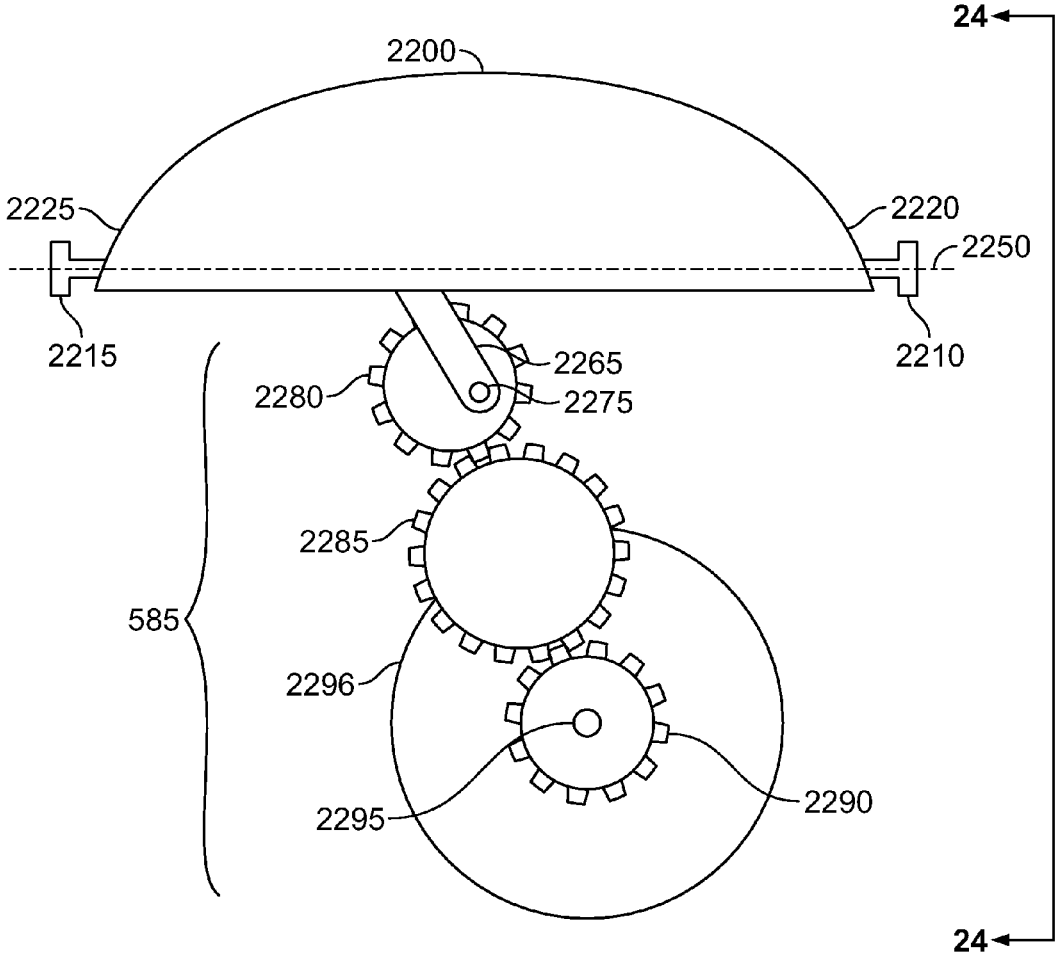
FIGS. 23, 27, and 29 are side views of a back region and a third actuation system of the internal assembly of FIGS. 2–4.
Figure 24:
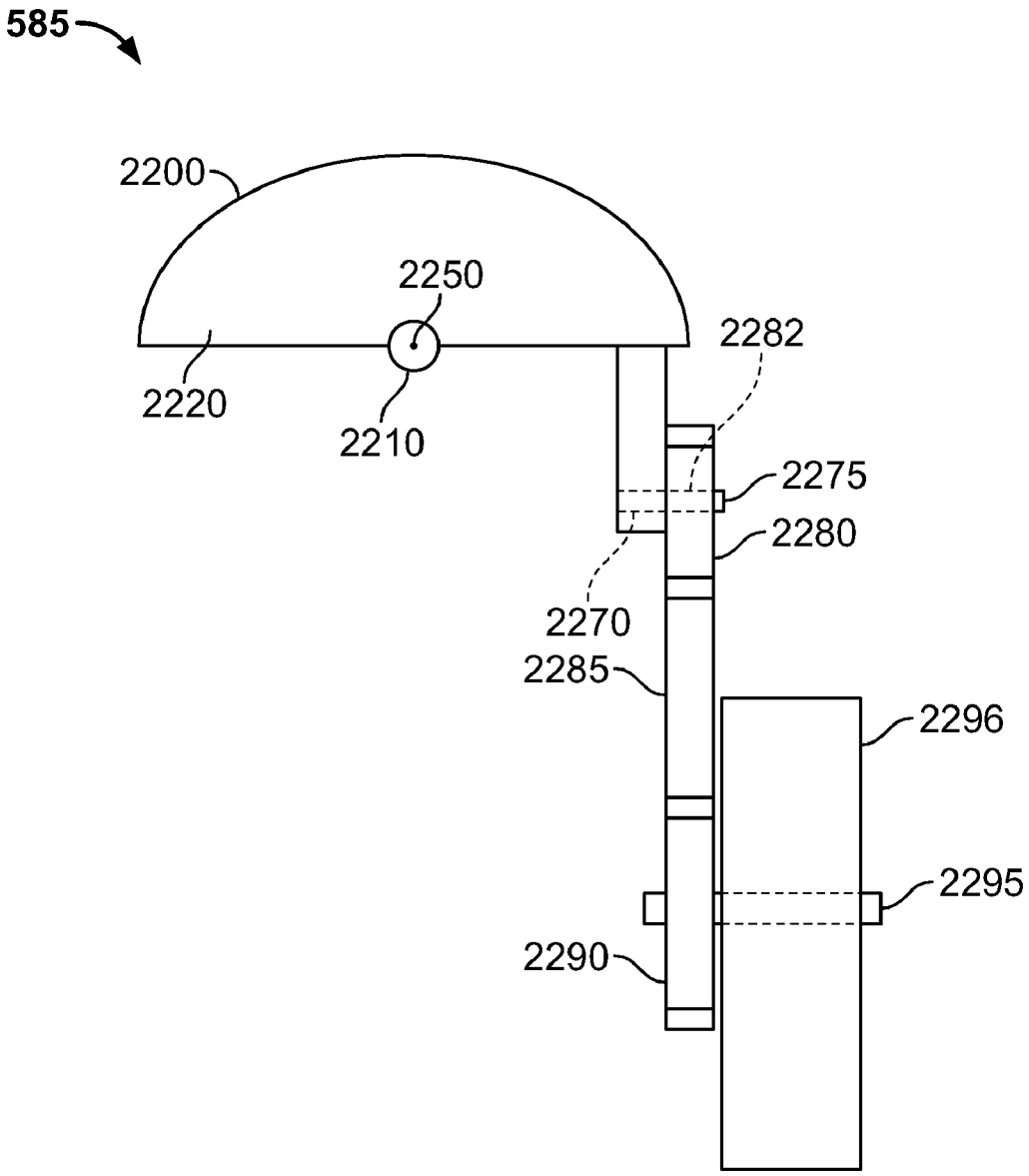
FIGS. 24, 28, and 30 are rear views of the back region and the third actuation system of the internal assembly of FIGS. 2–4.
Figure 25:
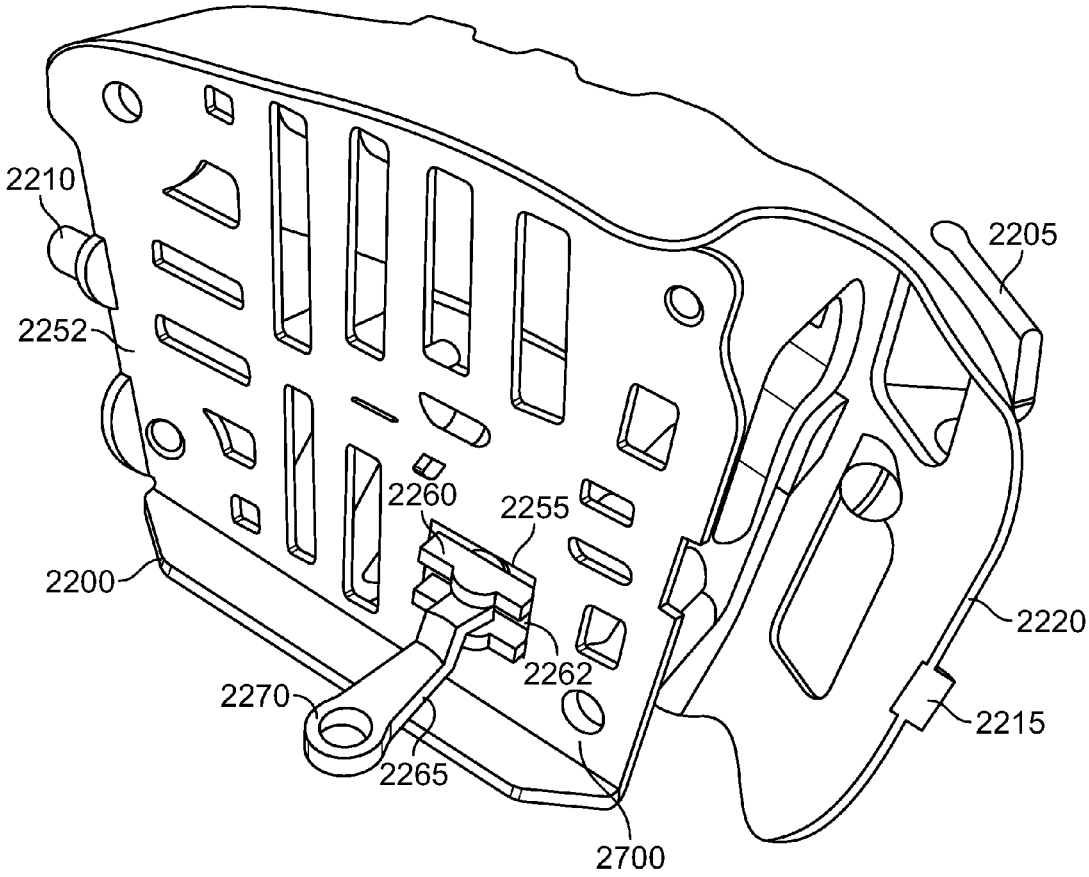
FIG. 25 is a perspective view of an interior of the back region of the internal assembly of FIGS. 2–4.

Referring again to FIGS. 2–4 and 8, and also to FIGS. 23–25, the back region 125 includes a back panel 2200 and a tail 2205 (shown in FIGS. 2–4, 8, and 25) connected to the back panel 2200. The back panel 2200 includes cylindrical projections 2210 and 2215 that extend from, respectively, side surfaces 2220 and 2225 of the back panel 2200. The cylindrical projection 2210 is shaped to fit within a cavity 2230 (shown in FIG. 8) of the second body panel 520 and a cavity (not shown) formed between a curved region (not shown) of an open side 2235 (shown in FIG. 8) of the second body panel 520 and a curved region 2240 of an internal piece 2245 (shown in FIG. 8) mounted to the second base 525. As shown in FIGS. 23 and 24, the back panel 2200 is configured to rotate or pivot about an axis 2250 extending from the projection 2210 to the projection 2215.

With reference to FIG. 25, the back panel 2200 includes a lower surface 2252 having an opening 2255. The opening 2255 receives a crank fixture 2260 that defines an opening 2262. As shown in FIGS. 23 and 24, the crank fixture 2260 is shaped to couple to the third actuation system 585 and is configured to move transversely and rotationally relative to the opening 2255.

Referring to FIGS. 23 and 24, the third actuation system 585 includes a crank 2265, a crank gear 2280, a coupling gear 2285, and wheel gear 2290. The crank 2265 includes an opening 2270 and the crank gear 2280 includes an opening 2282 offset from the center of rotation of the crank gear 2280. The crank 2265 and the crank gear 2280 are coupled together by an eccentric pin 2275 that is inserted through the openings 2270 and 2282. The crank gear 2280 includes teeth that mate with teeth on the coupling gear 2285, and the coupling gear 2285 includes teeth that mate with teeth on the wheel gear 2290. The wheel gear 2290 is fixed to an axle 2295 of one of the wheel regions 120 (also referred to as the wheel region 2296) within the second body portion 505.

Referring also to FIGS. 8 and 11–14, the third actuation system 585 is retained within the second body portion 505 between the second body panel 520 and the second base 525. In particular, the third actuation system 585 fits between base shelves 2300 and 2305 that protrude from the second base 525 and a wheel shelf 2310 (FIG. 8) that fits within and secures to a cavity 2315 of the base 525.

Figure 26:
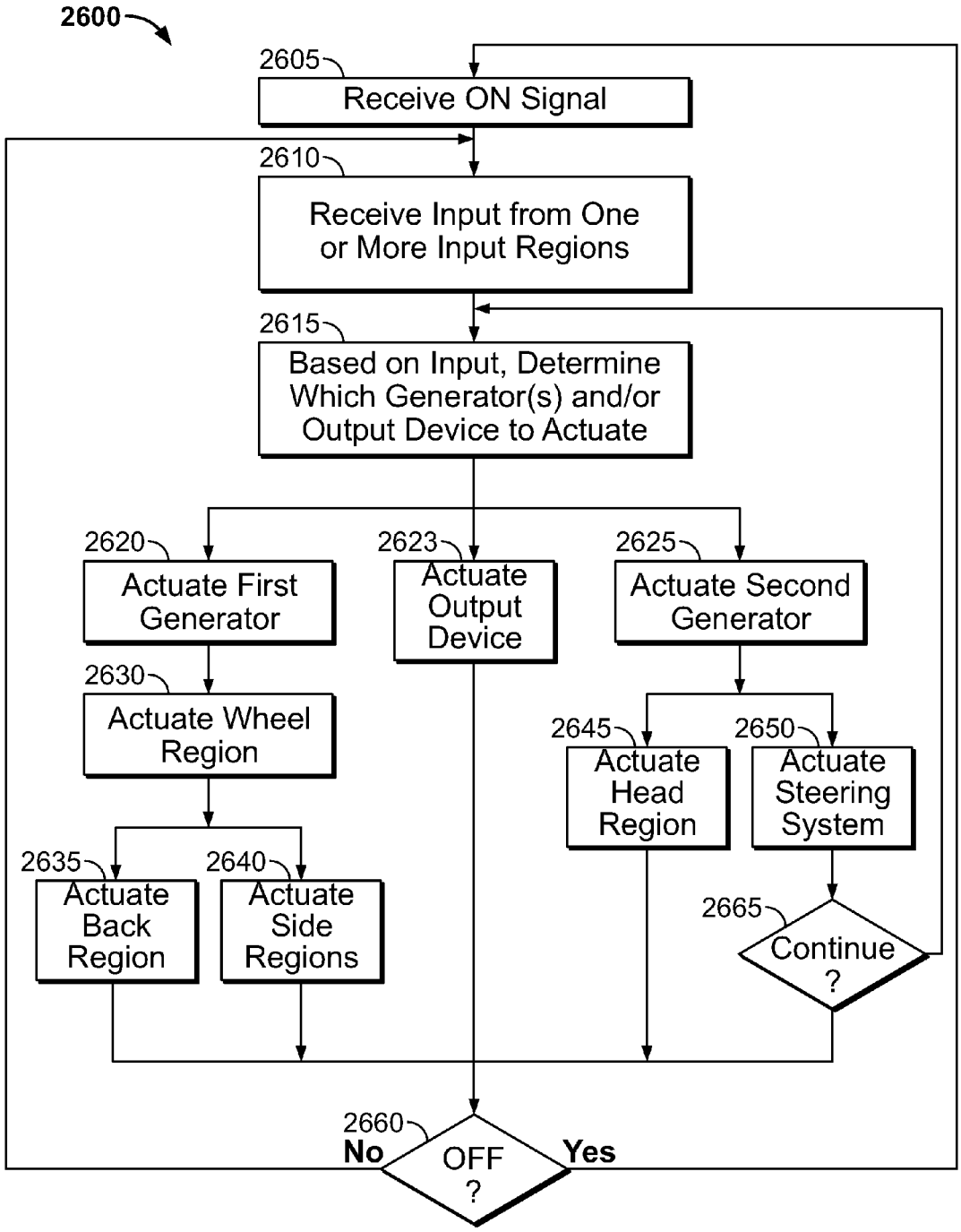
FIG. 26 is a flow chart of a procedure performed by the toy of FIG. 1.

Referring to FIG. 26, the toy 100 performs a procedure 2600 during operation. Initially, the internal circuitry 555 of the toy 100 receives a signal from the switch 565 to turn on the toy 100 (step 2605). Next, the internal circuitry 555 receives input from one or more of the input regions (step 2610). For example, with reference to FIG. 1, the circuitry 555 may receive input from the sensory region 140 within the head region 130 in response to pressure applied to the location 150 of the toy 100. As another example, the circuitry 555 may receive input from the sensory region 145 within the back region 125 in response to pressure applied to the location 155 of the toy 100. As a further example, the circuitry 555 may receive input from one of the sensory regions 147 within the second body portion 505 in response to pressure applied to the location 157 of the toy 100.

As shown in FIGS. 5 and 6, upon receiving the input (step 2610), the circuitry 555 determines the output device and which of the first and second motors 535 and 545 to actuate (step 2615) to cause an appropriate response from the toy 100. For example, the circuitry 555 may determine that the first and second motors 535 and 545 and the output device should be activated. As another example, the circuitry 555 may determine that only one of the first motor 535, the second motor 545, or the output device should be activated.

If the circuitry 555 determines (step 2615) that the first motor 535 should be actuated, then the first motor 535 is actuated (step 2620). If the circuitry 555 determines (step 2620) that the output device should be actuated, then the output device is actuated (step 2623). If the circuitry 555 determines (step 2620) that the second motor 545 should be actuated, then the second motor 545 is actuated (step 2625).

Actuation of the first motor 535 (step 2620) causes actuation of the wheel regions 120 within the first body portion 500 (step 2630). In particular, with reference to FIGS. 5, 10, 19, and 20, actuation of the first motor 535 rotates the motor shaft 1840, which rotates gear 1810. As gear 1810 rotates, gear 1815 rotates, which causes gear 1820 to rotate. Rotation of gear 1820 causes rotation of gear 1825, which causes rotation of gear 1830 and the clutch 1835. As mentioned, the clutch 1835 is keyed with the axle 1845.

Thus, as the clutch 1835 rotates, the axle 1845 rotates, which causes the wheel regions 120 within the first body portion 500 to rotate. Rotation of the wheel regions 120 causes the toy 100 to move forward (that is, in the direction of arrow 180 in FIG. 1) or backward (that is, in the direction of arrow 185 in FIG. 1), depending on the direction of rotation of the motor shaft 1840.

As the wheel regions 120 within the first body portion 500 are rotated (step 2630) and the toy 100 moves forward and backward, the back region 125 is actuated (step 2635). In particular, with reference to FIGS. 8 and 23–25, as the wheel region 120 within the first body portion 500 is rotated, both wheel regions 120 within the second body portion 505 are rotated because the toy 100 is moving forward or backward. As the wheel region 2296 is rotated, the wheel gear 2290 fixed to the axle 2295 rotates, causing the coupling gear 2285 to rotate. Rotation of the coupling gear 2285 causes rotation of the crank gear 2280.

Figure 27:
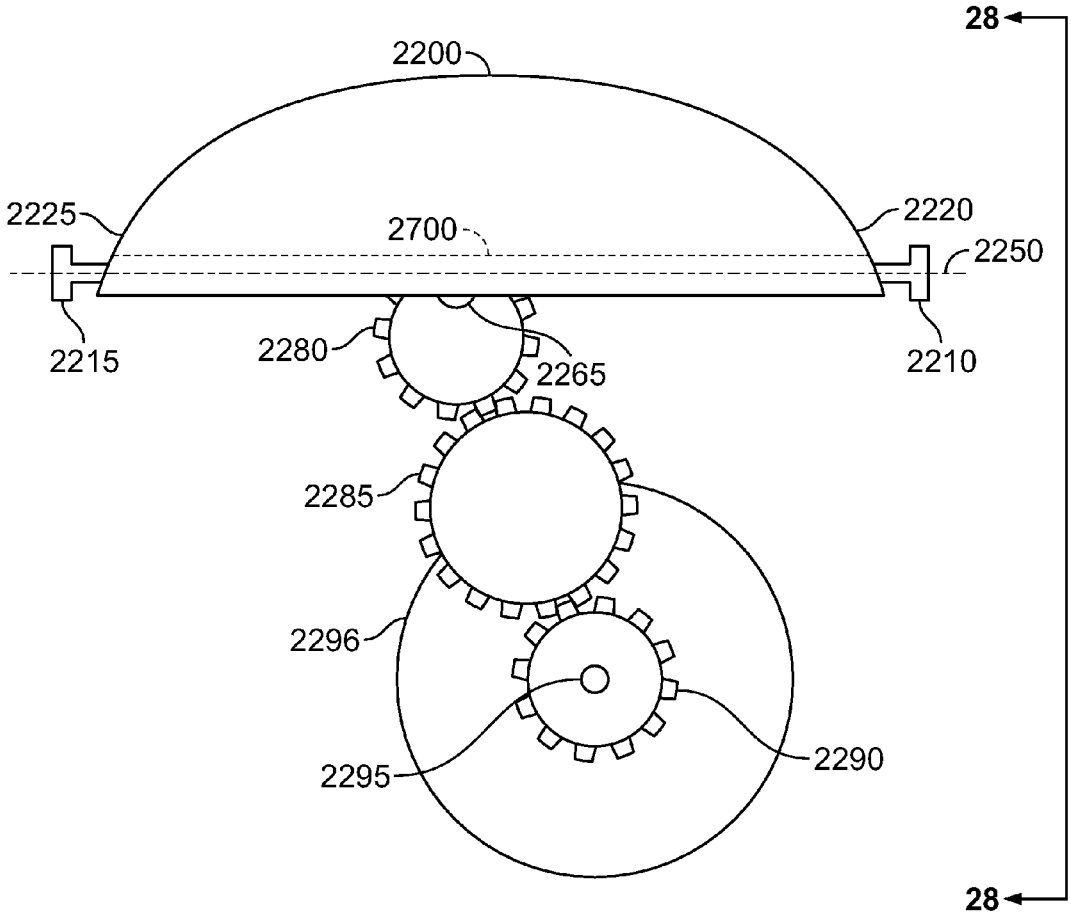
Figure 28:
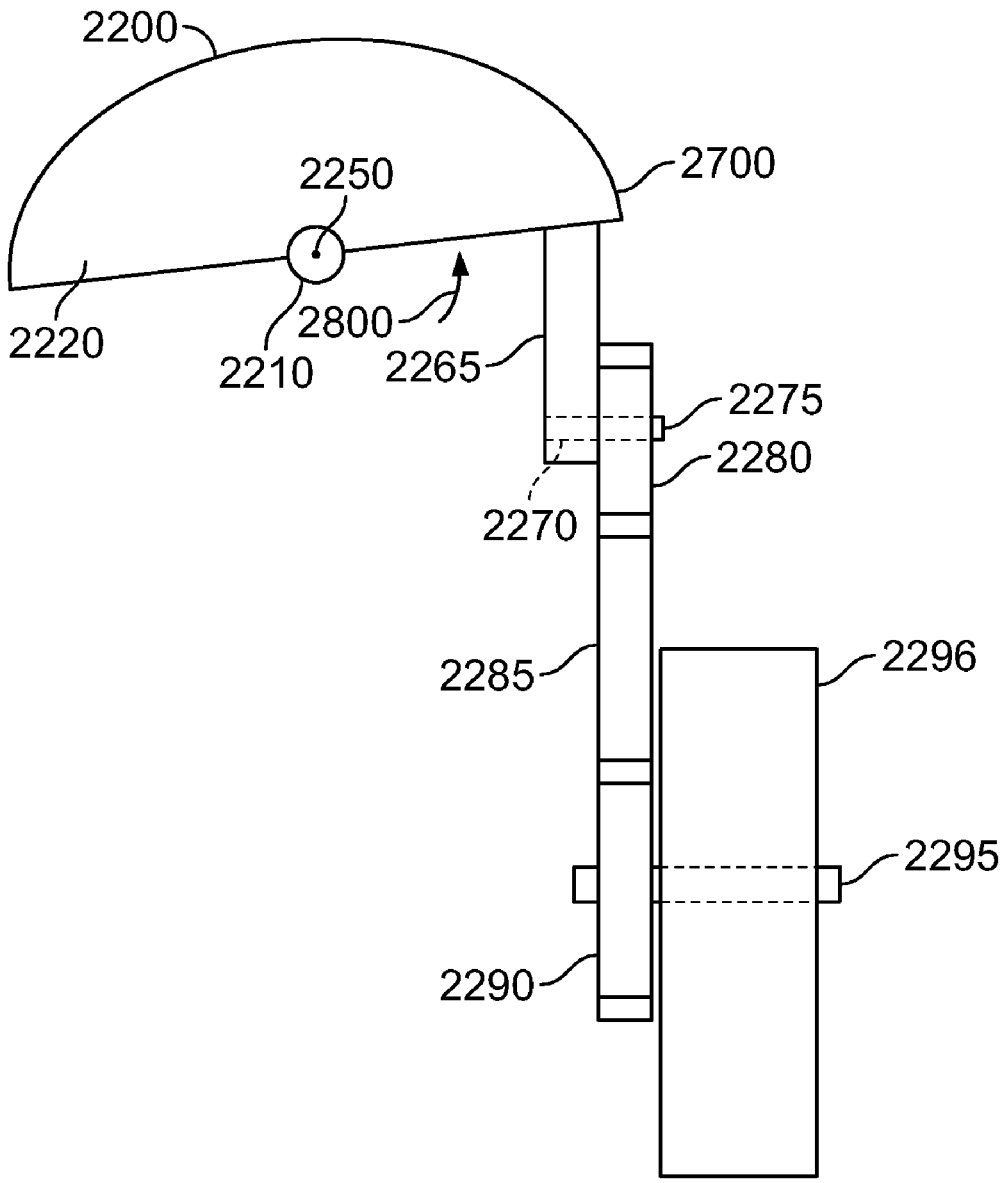
Figure 29:
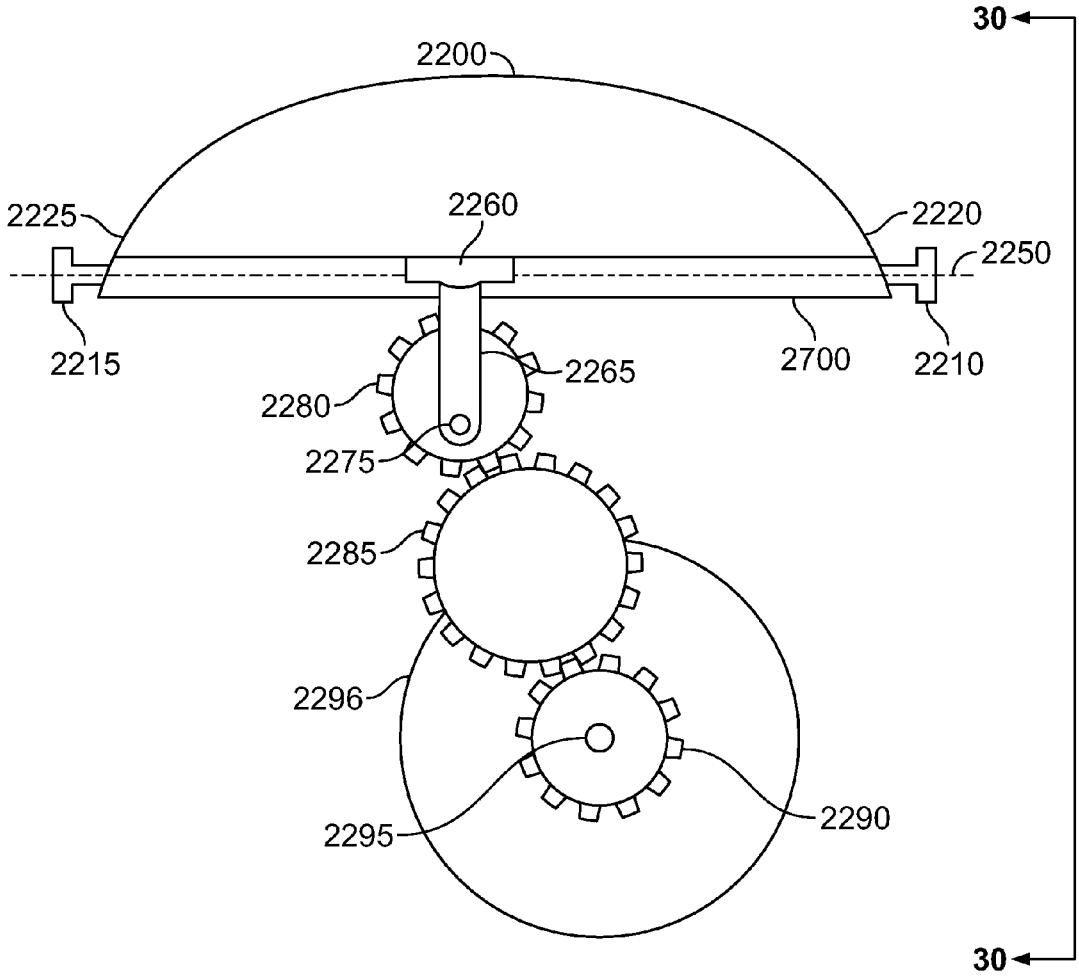
Figure 30:
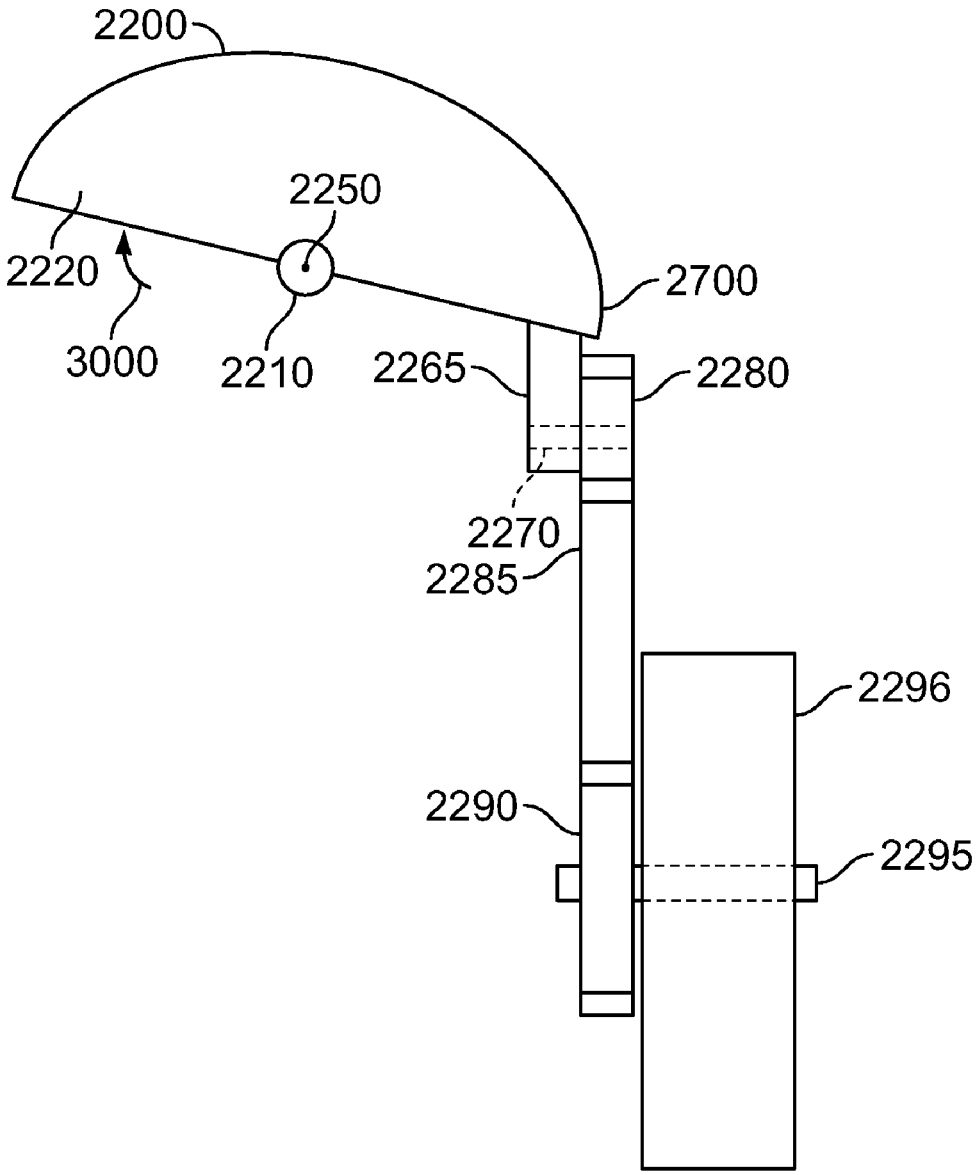

As the crank gear 2280 rotates, the pin 2275 rotates, causing the crank 2265 to move in a periodic motion. In this way, the energy of the rotation of the wheel region 2296 is imparted into translation of the crank 2265. Referring also to FIGS. 27 and 28, as the crank 2265 is moved upward (by the force of the pin 2275), the crank 2265 pushes on a side 2700 of the back panel 2200 and the back panel 2200 is rotated about the axis 2250 in the direction of arrow 2800. Referring also to FIGS. 29 and 30, as the crank 2265 is moved downward (by the force of the pin 2275), the crank 2265 pulls on the side 2700 of the back panel 2200 and the back panel 2200 is rotated about the axis 2250 in the direction of arrow 3000. Thus, in operation, as the toy moves forward or backward, the back panel 2200 oscillates about the axis 2250. Furthermore, the tail 2205, which is attached to the back panel 2200, moves in a wagging motion as the back panel 2200 oscillates.

As the wheel regions 120 within the first body portion 500 are actuated (step 2630) and the toy 100 moves forward and backward, the side regions 135 are actuated (step 2640). In particular, with reference to FIGS. 9, 10, 19, and 20, as the wheel regions 120 within the first body portion 500 are actuated (step 2630), the cams 122 in each of the wheel regions 120 are rotated. As one of the cams 122 rotates, the edge 141 of the protrusion 139 that is engaged with the cam 122 moves along the outer perimeter of the cam 122. The protrusion 139 is attached to the side region 135, which is rotatably attached to the body panel piece 900 or 905. In this way, as the protrusion 139 moves along the outer perimeter of the cam 122, the side region 135 rotates about the connector 137, thus causing the side region 135 to oscillate, that is, move in a back and forth or periodic motion. Such a motion imparts a realistic appearance that the toy 100 is walking forward or backward.

Actuation of the output device (step 2623) causes the output device to output a response. For example, if the output device is the audio device 570, actuation of the audio device 570 causes the audio device 570 to emit one or more sounds such as, for example, a bark, a pant, a whine, a growl, or a yawn if the toy 100 is in the form of a dog. In general, the one or more sounds emitted from the audio device 570 would correlate with the design or appearance of the toy 100. The one or more sounds emitted from the audio device 570 may correlate with actuation of the first and/or second motors. Thus, if the first motor 535 causes the toy 100 to move forward and backward in a rapid motion, the audio device 570 may emit several panting sounds.

Referring also to FIG. 18, as the wheel regions 120 are actuated (step 2630), the toy 100 moves forward 180 or backward 185 and the lower end 1730 of the pendulum 1735 swings. Thus, the lower end 1730 swings backward (that is, away from the first rounded portion 1085) as the toy 100 moves forward, and the lower end 1730 swings forward (that is, toward the first rounded portion 1085) as the toy 100 moves backward. As the lower end 1730 swings backward, the connector 1725 moves the catch device 1710 backward, which causes the first and second pieces 1704 and 1706 of the pivoting member 1700 to pivot about an axis 1880 defined along protrusions 1705 in the direction of arrow 1885. As the lower end 1730 swings forward, the connector 1725 moves the catch device 1710 forward, causing the first and second pieces 1704 and 1706 of the pivoting member 1700 to pivot about the axis 1880 in the direction of arrow 1890.

In the illustrated implementation, where the toy 100 is shaped to resemble a dog, the first piece 1704 resembles a tongue. Thus, as the toy 100 moves back and forth in rapid succession, the lower end 1730 swings forward and backward rapidly (that is, the lower end 1730 oscillates) and the tongue bobs up and down in a rapid succession. Simultaneous with the rapid motion of the tongue, the circuitry 555 actuates the audio device 570 to emit a panting sound. In this way, a realistic panting action is imparted to the toy 100.

Actuation of the second motor 545 (step 2625) causes actuation of the head region 130 (step 2645). In particular, with reference to FIGS. 6 and 9–17, actuation of the second motor 545 causes the motor shaft 925 to rotate, which causes the shaft pulley 930 to rotate. As the shaft pulley 930 rotates, the drive belt 935, through frictional engagement with the shaft pulley 930 and the drive pulley 940, causes the drive pulley 940 to rotate. The drive pulley 940 rotates the worm gear 950, which is coupled to the first set of gear teeth on gear 955. In this way, gear 955 is rotated. As gear 955 rotates, the second set of gear teeth engage the teeth on gear 960 and cause gears 960 and 965 to rotate. As gear 965 rotates, the teeth on gear 965 engage the first set of teeth on gear 970 to cause gear 970 to rotate. The second set of teeth on gear 970 rotate and cause gear 975 to rotate. Because gear 980 is frictionally engaged with gear 975, gear 980 rotates with gear 975 and causes gear 985 to rotate.

Figure 16:
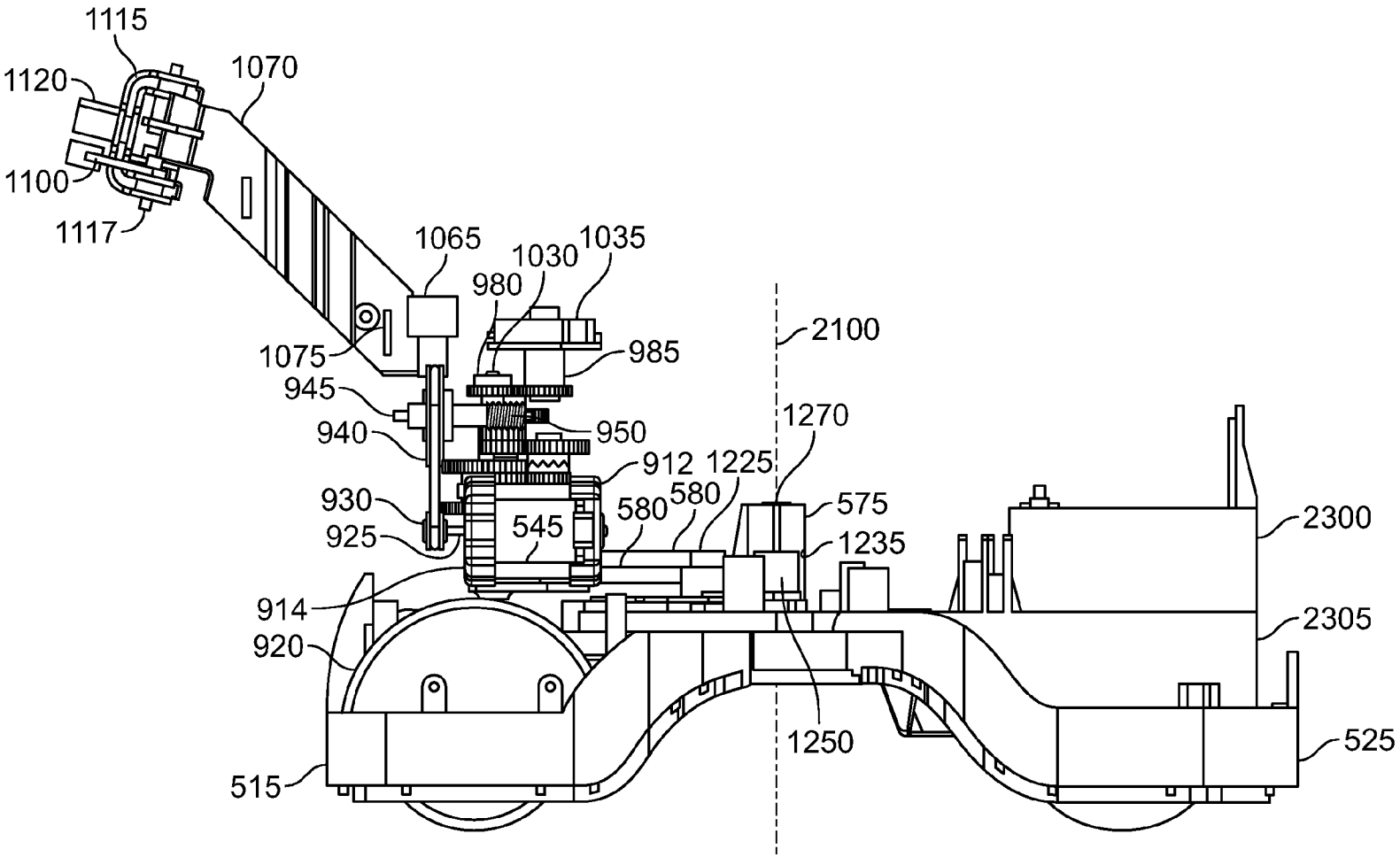
FIG. 16 is a side view of the internal assembly of FIGS. 2–4 with the body panels removed.

As shown in FIGS. 11 and 16, gear 985 is frictionally engaged with the neck pulley 1035. Thus, as gear 985 rotates, the neck pulley 1035 rotates and actuates the elongated devices 1050 and 1055 (seen in FIG. 17) to animate the head region 130, as detailed below.

Figure 31:
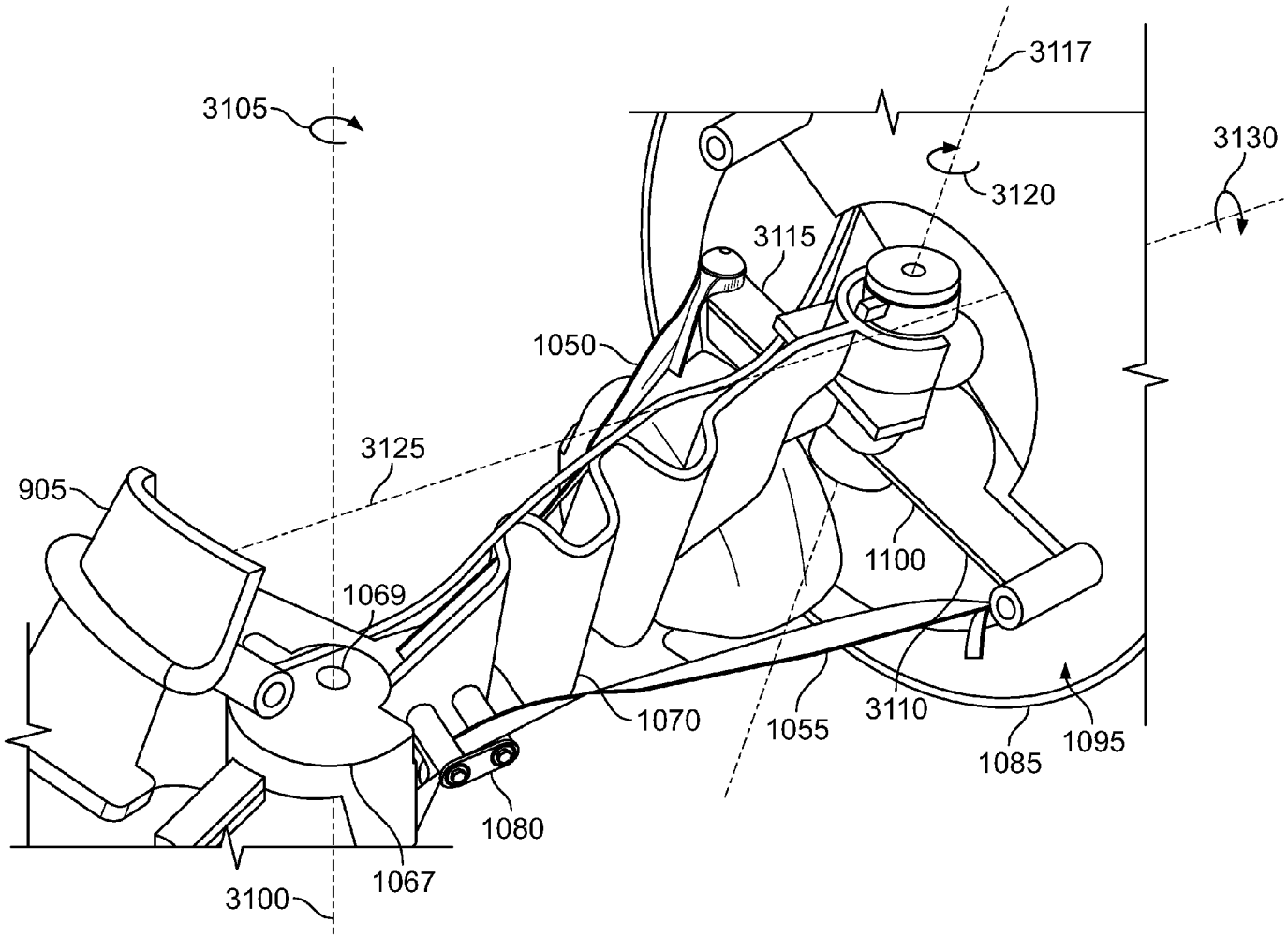
FIGS. 31 and 32 are perspective views of a portion of the head region of the internal assembly of FIGS. 2–4.

Referring also to FIG. 31, the elongated device 1055 is tensioned or pulled and the elongated device 1050 is slackened due to the rotation of the pulley 1035 in a first direction. The combined motion of the elongated devices 1050 and 1055 causes the neck device 1070 to rotate about the axis 3100 extending along the shaft 1069 and in the direction of arrow 3105. Next, after the neck device 1070 rotates a predetermined distance, the elongated device 1055 pulls a first side 3110 of the tilt lever 1100 and the elongated device 1050 provides slack to a second side 3115 of the tilt lever 1100. This combined motion rotates the tilt lever 1100 about the axis 3117 extending along the shaft 1117 in the direction of arrow 3120. The rotation of the tilt lever 1100 causes the first rounded portion 1085 (and anything fixed to the first rounded portion 1085) to rotate about the axis 3125 extending along the longitudinal length of the posts 1120 and 1125 in the direction of arrow 3130.

Figure 32:
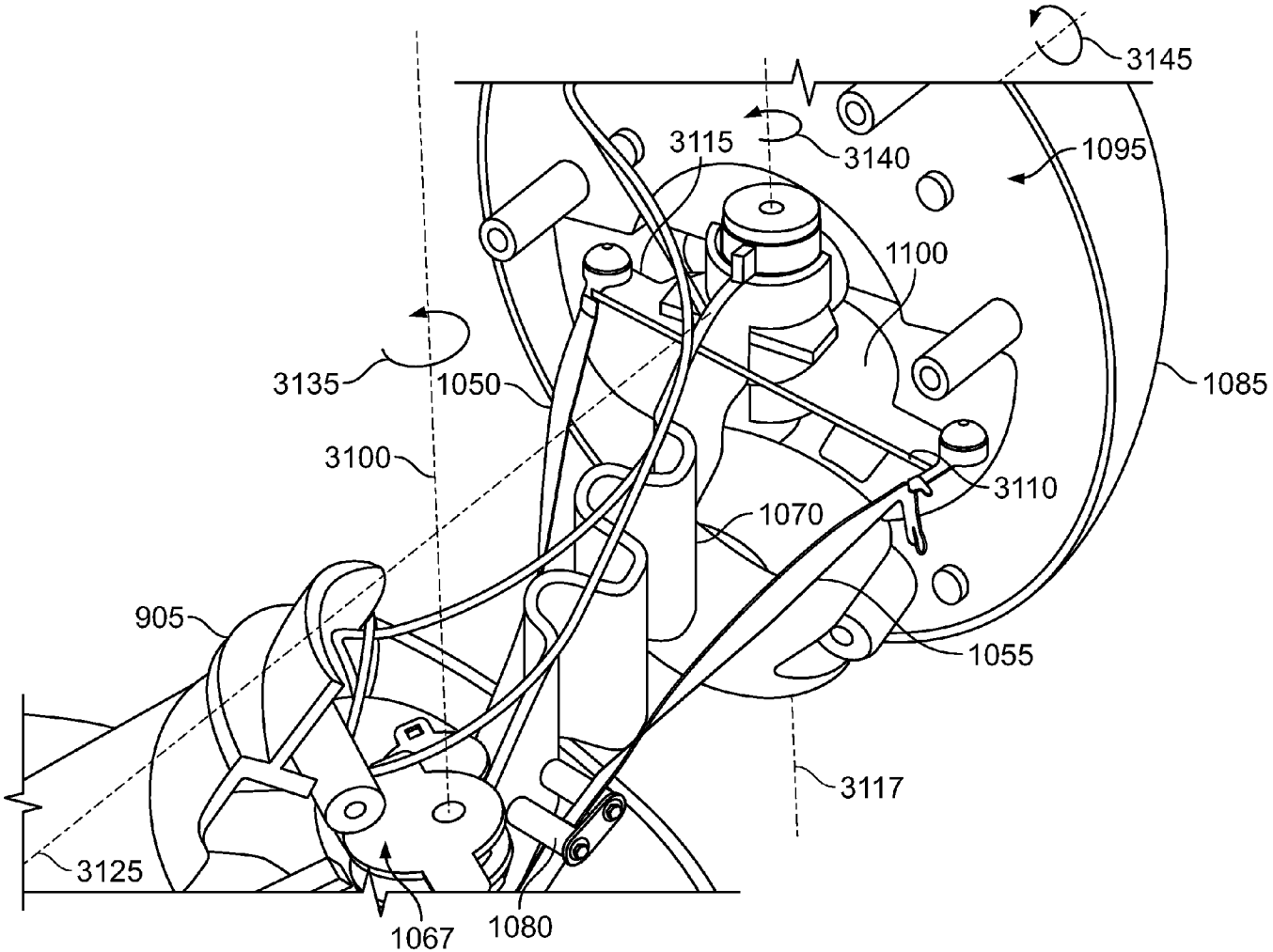

Referring also to FIG. 32, the elongated device 1055 is slackened and the elongated device 1050 is tensioned or pulled due to rotation of the pulley 1035 in a second direction that is opposite the first direction. The combined motion of the elongated devices 1055 and 1050 causes the neck device 1070 to rotate about the axis 3100 in the direction of arrow 3135. After the neck device 1070 rotates a predetermined distance, the elongated device 1055 provides slack to the first side 3110 of the tilt lever 1100 and the elongated device 1050 pulls the second side 3115 of the tilt lever 1100. This combined motion rotates the tilt lever 1100 about the axis 3117 in the direction of arrow 3140. The rotation of the tilt lever 1100 in the direction of arrow 3140 causes the first rounded portion 1085 (and anything fixed to the first rounded portion 1085) to rotate about the axis 3125 in the direction of arrow 3145.

The combined motion of the neck device 1070 and the first rounded portion 1085 imparts a realistic motion to the toy 100 and is achieved with a single actuation system, that is, the second actuation system 550.

Moreover, actuation of the second motor 545 (step 2625) causes actuation of the steering system 538 (step 2650). In particular, with reference to FIGS. 6, 8, 9, 11–16, and 20–22, and as discussed above, gear 975 is rotated as the second motor 545 is actuated. Rotation of gear 975 causes rotation of gear 995, which causes rotation of gear 990. Gear 990 is fixed to the shaft 1030 and the shaft 1030 rotates as gear 990 rotates, which causes the post 1205 and the steering bar 530 to rotate. As the steering bar 530 rotates, the linkages 580 connected to the posts 1210 and 1215 of the steering bar 530 are pulled or pushed.

Figure 33:
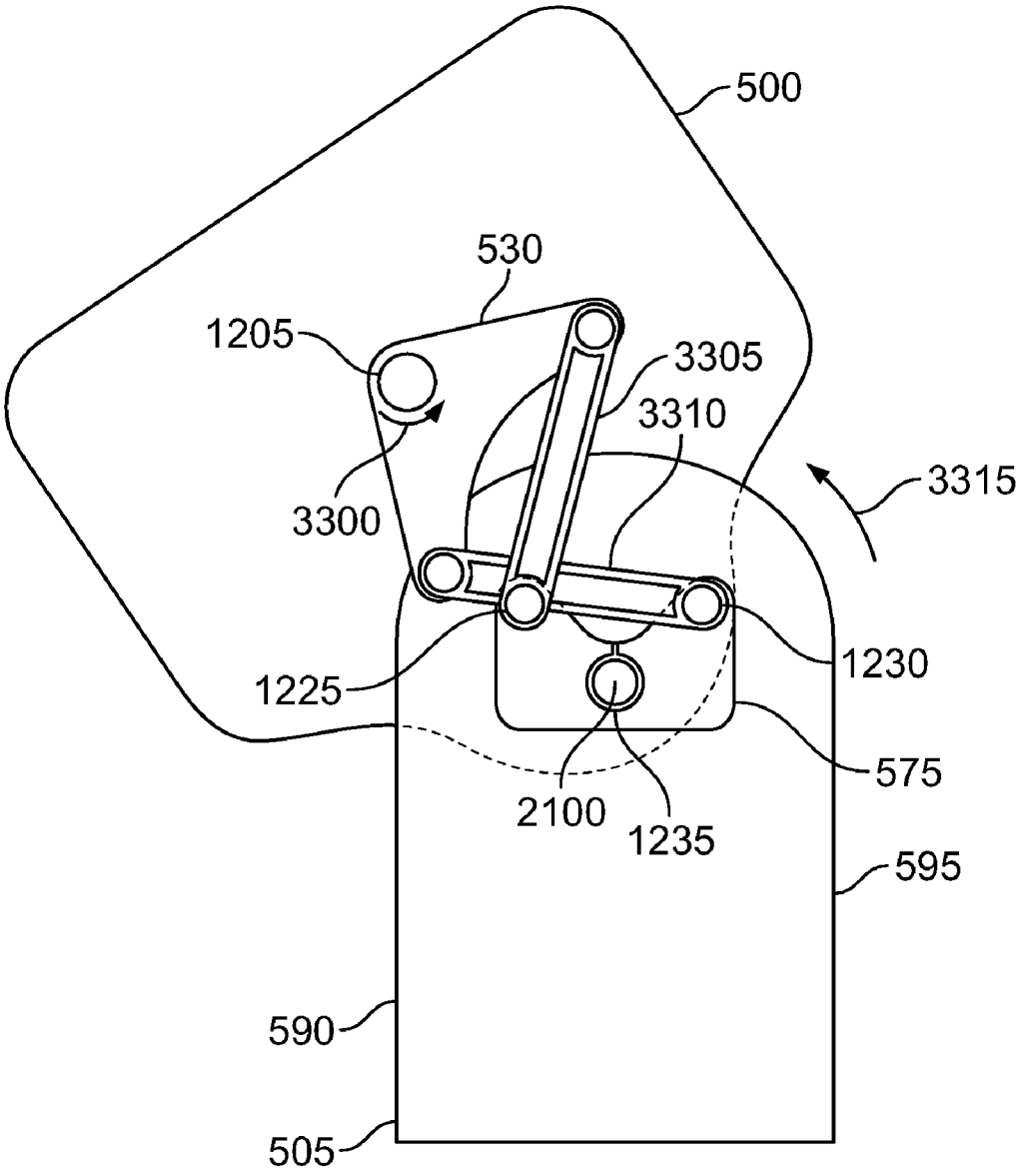
FIGS. 33–36 are block diagrams showing relative motion between the first and second body portions of the internal assembly of FIGS. 2–4.

Referring also to FIG. 33, as the steering bar 530 rotates in a first direction (indicated by arrow 3300), a first linkage 3305 is pulled while a second linkage 3310 is pushed. The first and second linkages 3305 and 3310 are connected, respectively, to posts 1230 and 1225 of the hinge device 575. Thus, the force applied to the linkages 3305 and 3310 causes the first body portion 500 to rotate relative to the second body portion 505 about an axis 2100 defined by the posts 1235 and 1237 in the direction of arrow 3315.

Figure 34:
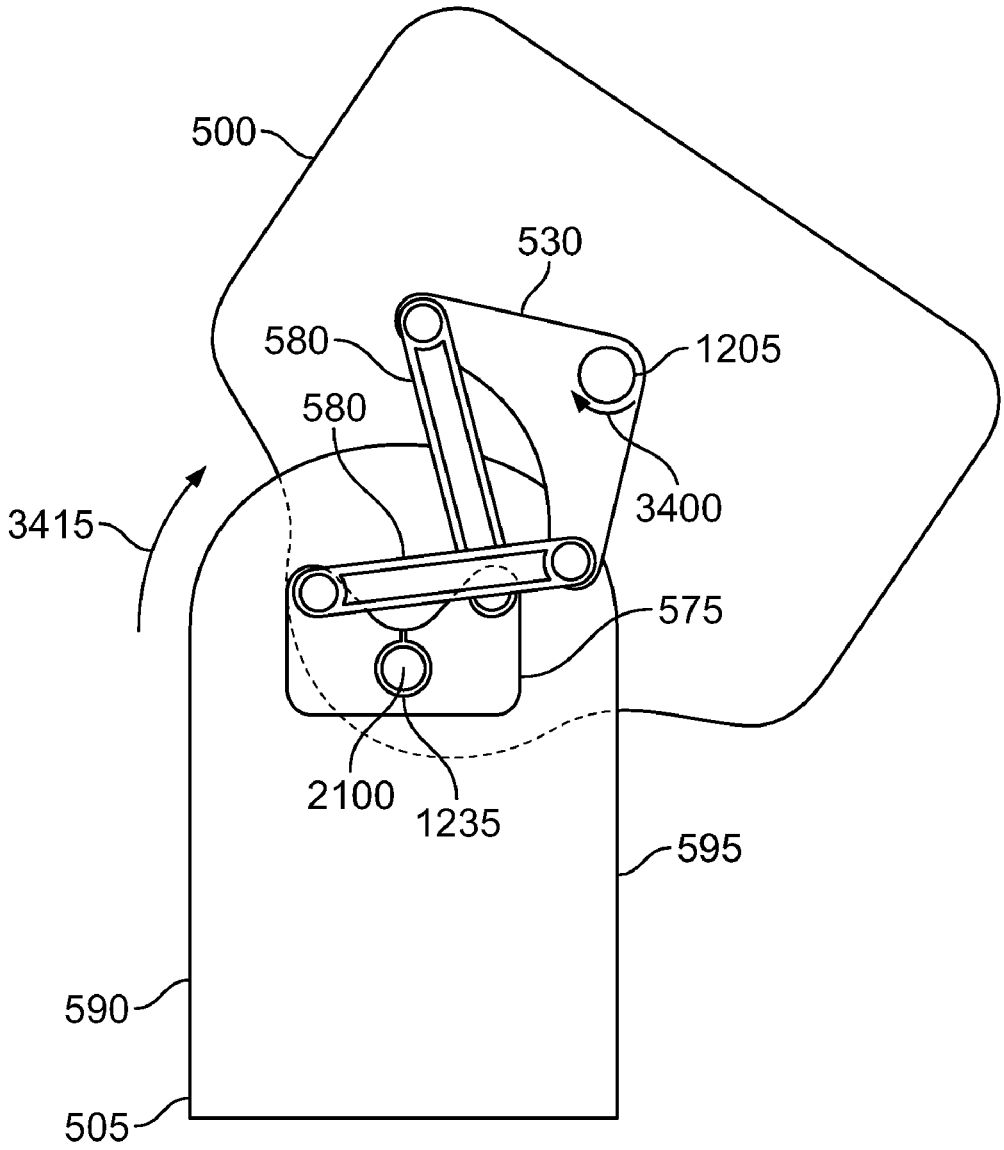

Referring also to FIG. 34, as the steering bar 530 rotates in a second direction (indicated by arrow 3400) that is opposite the first direction 3300, the first linkage 3305 is pushed while the second linkage 3310 is pulled. The force applied to the linkages 3305 and 3310 causes the first body portion 500 to rotate relative to the second body portion 505 about the axis 2100 in the direction of arrow 3415.

Actuation of the steering system 538 (step 2650) may be in response to input received from one of the sensory regions 147 (step 2615). Thus, if the circuitry 555 receives a signal from a sensory region 147 on a first side 590 (FIGS. 5, 6, 33, and 34) of the second body portion 505, the first body portion 500 rotates in the direction of arrow 3315 (FIG. 33), that is, toward the location of the input. Alternatively, if the circuitry 555 receives a signal from a sensory region 147 on a second side 595 (FIGS. 5, 6, 33, and 34) of the second body portion 505, the first body portion 500 rotates in the direction of arrow 3415 (FIG. 34), that is, toward the location of the input.

Actuation of the steering system 538 (step 2650) may, for particular input (step 2615) occur simultaneously with actuation or animation of the head region 130 (step 2645). Thus, for example, if the circuitry 555 receives input from the sensory region 147 on the first side 590 (FIGS. 5, 6, 33, and 34) of the second body portion 505, the circuitry 555 simultaneously causes the first body portion 500 to rotate in the direction of arrow 3315 (FIG. 33) and causes the head region 130 to animate as shown in FIG. 32. As another example, if the circuitry 555 receives input from the sensory region 147 on the second side 595 (FIGS. 5, 6, 33, and 34) of the second body portion 505, the circuitry 555 simultaneously causes the first body portion 500 to rotate in the direction of arrow 3415 (FIG. 34) and causes the head region 130 to animate as shown in FIG. 31.

Figure 35:
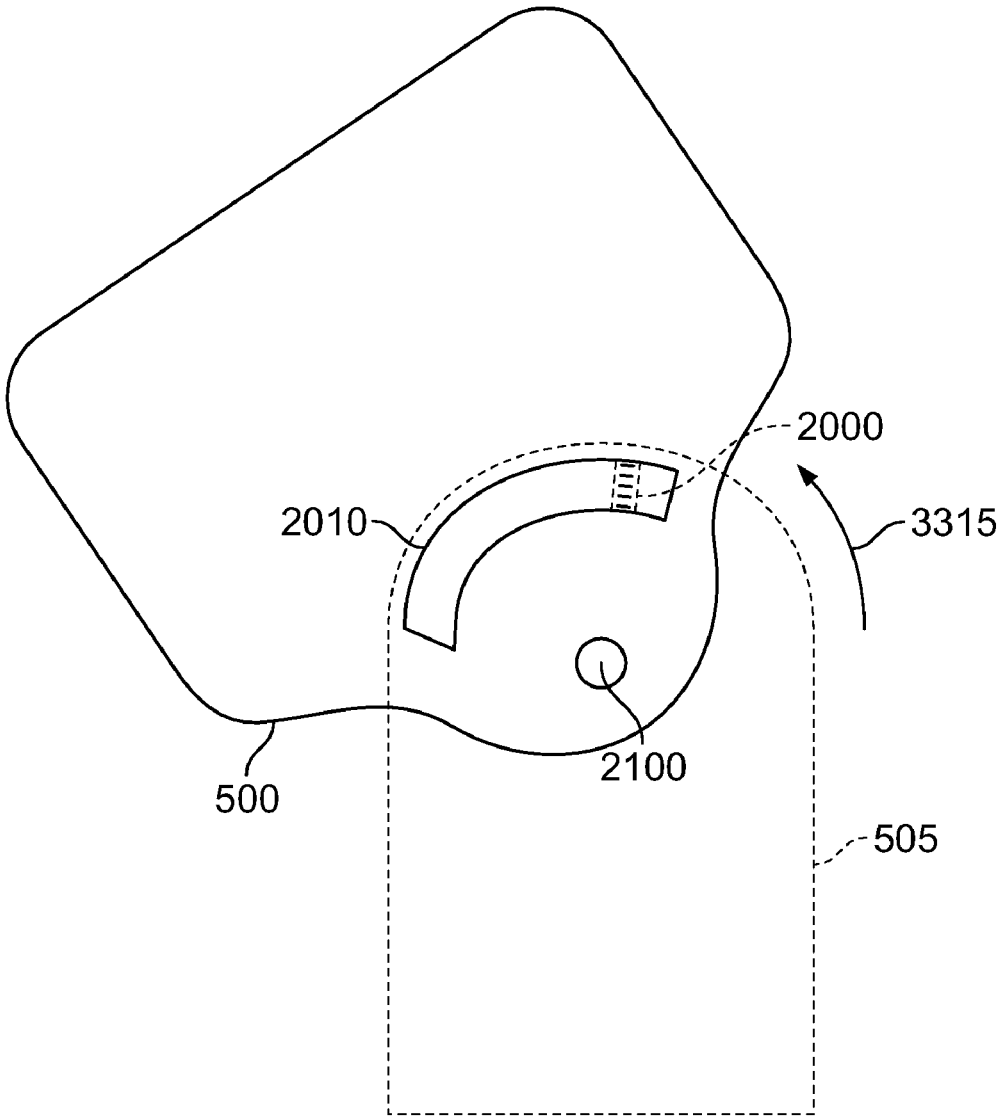
Figure 36:
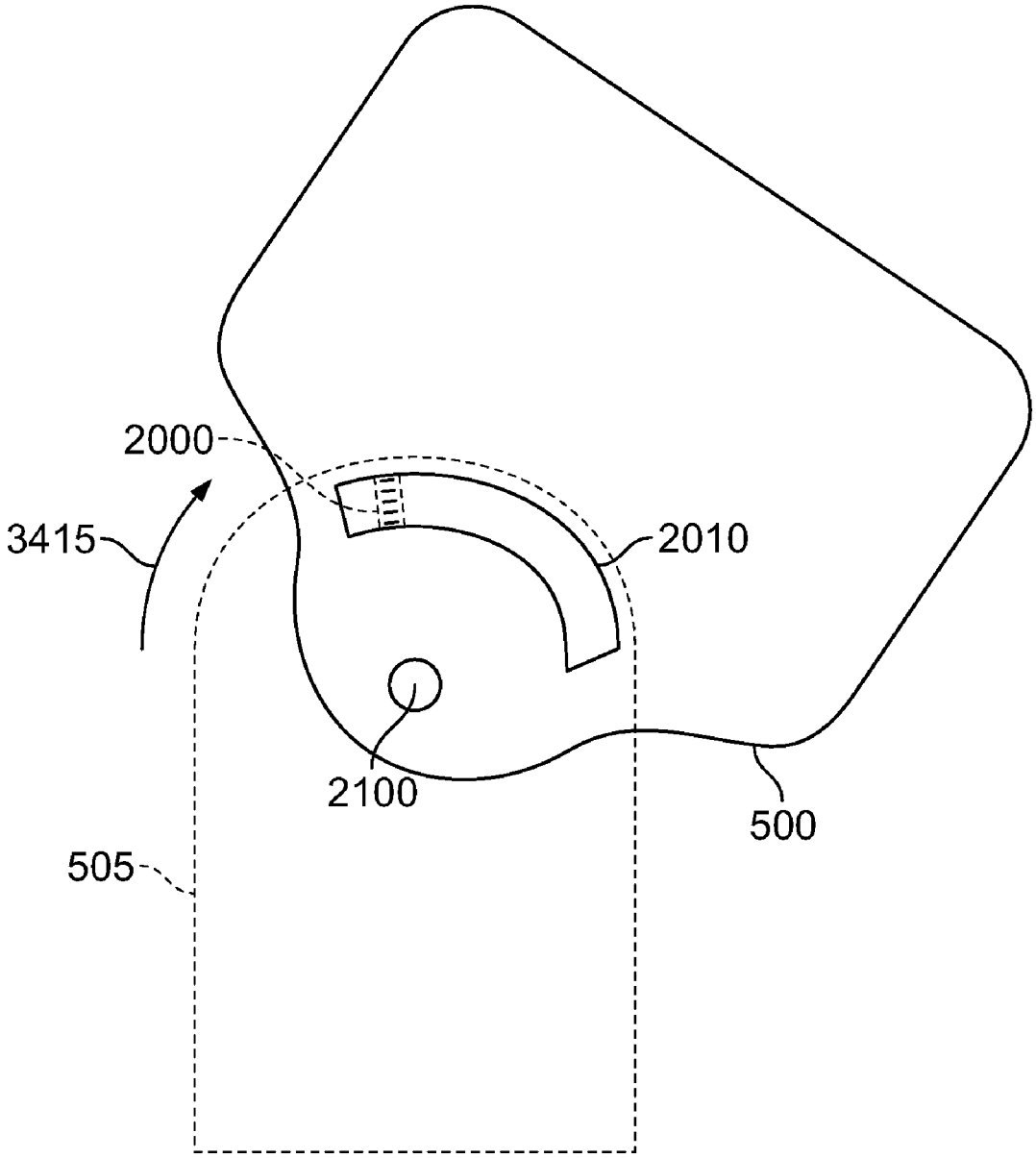

Referring also to FIGS. 35 and 36, as the first body portion 500 rotates relative to the second body portion 505, the wiper contact 2010 fixed to the first body portion 500 passes over the set of conductive wipers 2000 on the second body portion 505. The electrical signal from the conductive paths 2030–2055 of the wiper contact 2010 changes as the wiper contact 2010 moves across the wipers 2000. The circuitry 555 receives the electrical signal and determines the position of the first body portion 500 relative to the second body portion 505. The circuitry 555 decides whether additional actuation of the first or second motors or the output device is required (step 2655) based on the position of the first body portion 500 relative to the second body portion 505. If no additional actuation is required, the circuitry 555 awaits a signal from the switch 565 to turn off the toy 100 (step 2660) or the circuitry 555 enters sleep mode if no input has been received within a predetermined period of time.

Other implementations are within the scope of the following claims. For example, the toy 100 may be designed to resemble other animals, such as a cat. The toy 100 also may be designed without a flexible skin. The flexible skin 110 may include rigid pieces, such as, for example, posts, that interfit with cavities of the internal assembly 105 to facilitate securing of the skin 110 to the assembly 105. Additionally, ears, eyes, and a nose may be formed into the skin 110 instead of the internal assembly 105 to facilitate securing of the skin 110 to the assembly 105. The toy 100 may include a resilient material between the internal assembly 105 and the flexible skin 110 to further enhance realism of the toy 100.

The sounds emitted from the audio device 570 may correlate with the form of the toy 100. Thus, if the toy 100 is in the form of a cat, the audio device 570 may emit a purring sound or a meowing sound.

The toy may include additional sensory regions positioned within any one or more of the first body portion 500, the second body portion 505, one or more wheel regions 120, the head region 130, or one or more side regions 135.

One or more of the sensory regions may include a magnetic switch, such as, for example, a reed switch or a Hall effect sensor, that is actuated by an external magnet when the magnet is placed at the location near the sensory region. One or more of the sensory regions may include touch-sensitive devices. For example, the sensory region may be made of a conductive material and be a capacitively-coupled device such that when a user touches the toy 100 at the location of the sensory region, a measured capacitance associated with the capacitively-coupled device changes and the change is sensed. As another example, the sensory region may be made of a conductive material and be an inductively-coupled device. In this case, when a user touches the toy 100 at the location of the sensory region, a measured inductance associated with the inductively-coupled device changes and the change is sensed.

One or more of the sensory regions may include a pressure sensing device such as, for example, a pressure-activated switch in the form of a membrane switch. One or more of the sensory regions may include a light-sensing device, such as, for example, an IR-sensing device or a photocell. Additionally or alternatively, one or more of the sensory regions may include a sound-sensing device such as, for example, a microphone.

The internal control circuitry, the battery, and the output device may be housed in other parts of the internal assembly. For example, the circuitry, the battery, and the audio device may all be housed in the first body portion or all be housed in the second body portion.

The toy 100 may be of any design, such as, for example, a doll, a plush toy such as a stuffed animal, a dog or other animal, or a robot. The output device may be an optical device or an electromechanical device.

In another implementation, the elongated devices 1050 and 1055 may be made of a flexible, yet firm material, such as a wire strip that may be pulled or pushed.

Figure 37:
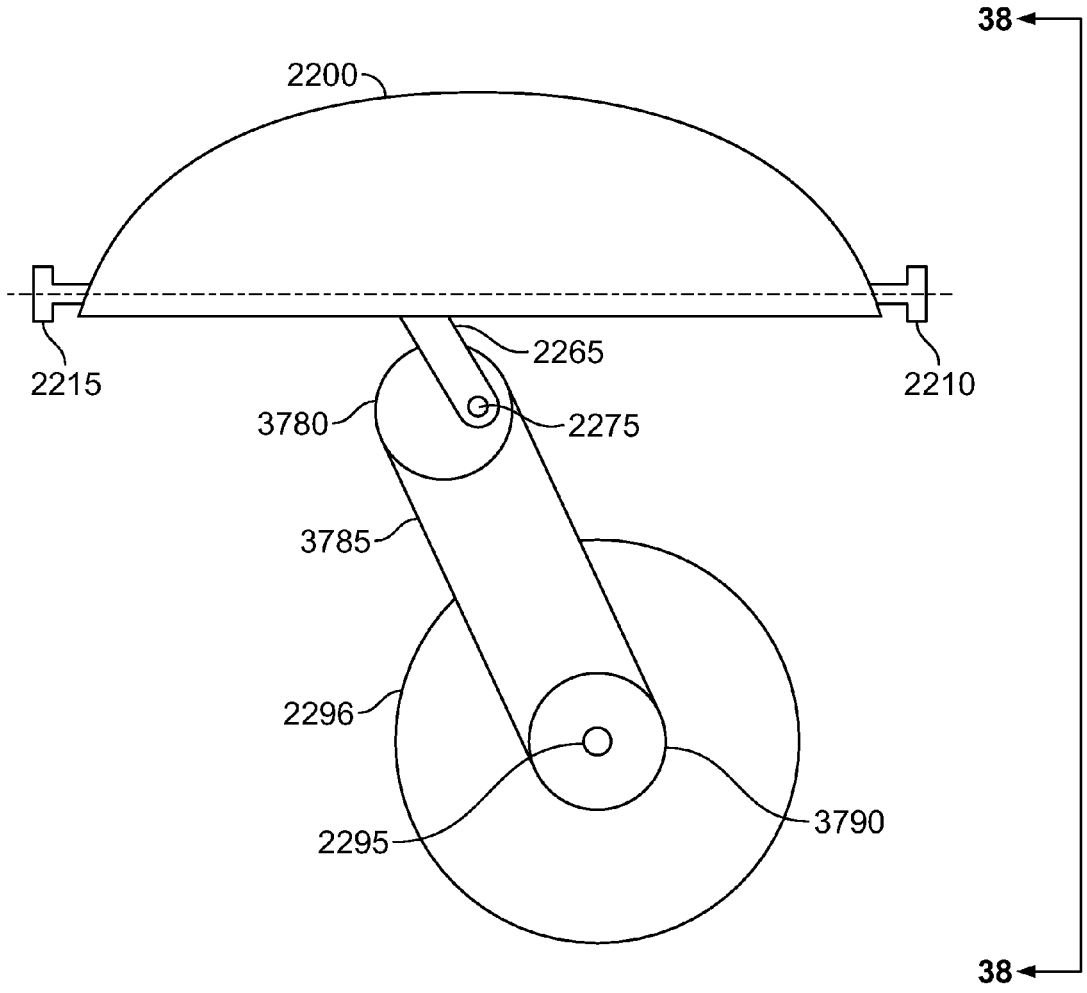
FIG. 37 is a side view of the back region and another implementation of the third actuation system.
Figure 38:
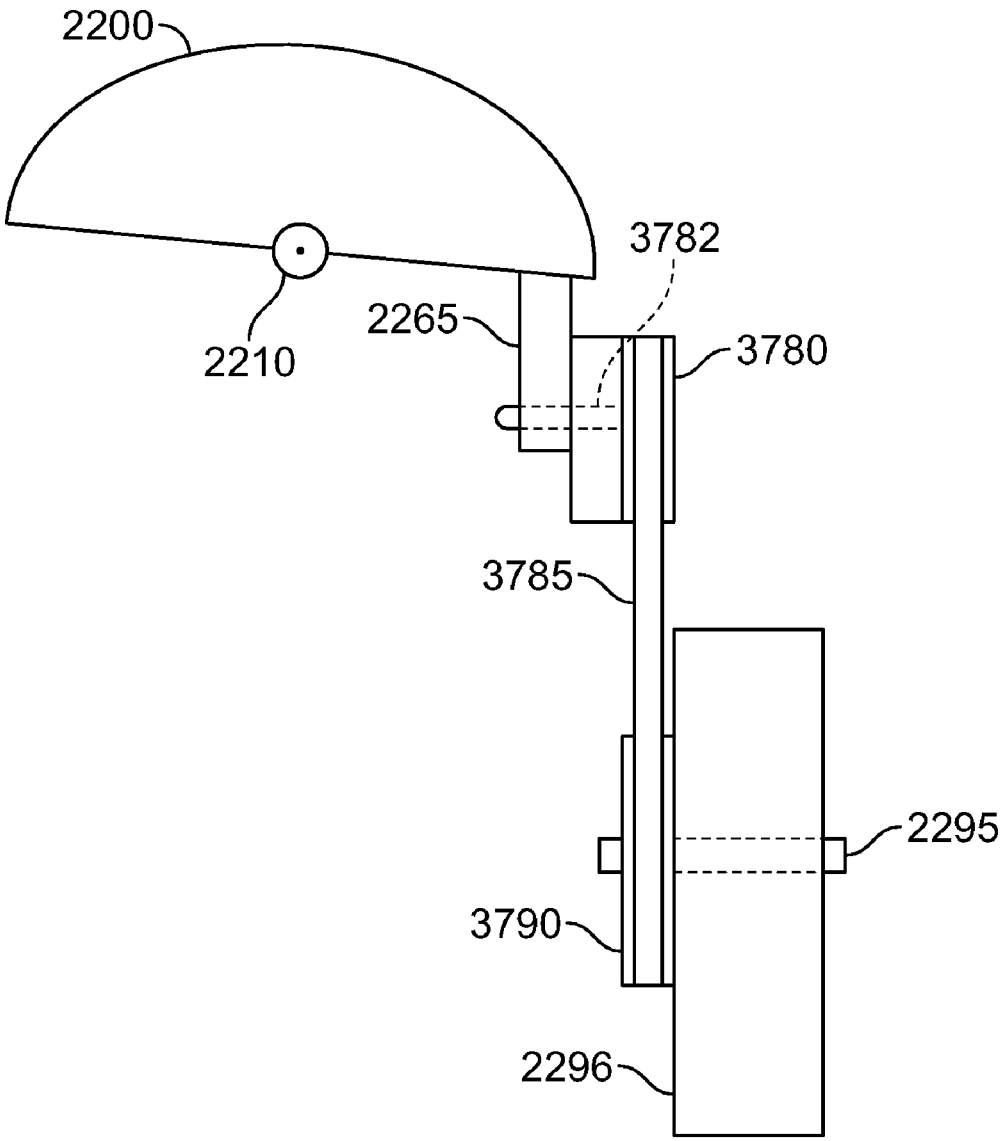
FIG. 38 is a rear view of the back region and the other implementation of the third actuation system of FIG. 37.

Referring also to FIGS. 37 and 38, in another implementation, the third actuation system 585 is formed of the crank 2265, a crank pulley 3780, a coupling belt 3785, and a wheel pulley 3790. The crank pulley 3780 includes an opening 3782 offset from the center of rotation of the crank pulley 3780. The crank 2265 and the crank pulley 3780 are coupled together by the eccentric pin 2275 inserted through the openings 2270 and 3782. The crank belt 3785 is frictionally engaged with the crank pulley 3780 and the wheel pulley 3790. The wheel pulley 3790 is fixed to the axle 2295 of the wheel region 2296 within the second body portion 505.

As the wheel region 2296 is rotated, the wheel pulley 3790 fixed to the axle 2295 rotates, causing the coupling belt 3785 to move and rotate the crank pulley 3780.

What is claimed is:

1. A toy comprising:

a body;

a wheel region that rotates about a wheel axis, the wheel region being coupled to the body such that the body moves along a moving direction as the wheel region rotates about the wheel axis;

a back region coupled to the body; and an actuation system within the body and coupled to the back region to oscillate the back region about a back axis that is perpendicular to the wheel axis and that is parallel to the moving direction as the wheel region rotates.

2. The toy of claim 1 further comprising:

a drive wheel region that rotates about a drive wheel axis that is parallel to the wheel axis and causes the body to move in the moving direction that is perpendicular to the drive wheel axis.

3. The toy of claim 1 further comprising:

a drive wheel region attached to the body to rotate about a drive wheel axis;

a motor; and a second actuating system coupled to the motor and to the drive wheel region to move the body in the moving direction that is perpendicular to the drive wheel axis.

4. The toy of claim 3 wherein motion of the body causes the wheel region to rotate about the wheel axis.

5. The toy of claim 1 wherein the back region comprises a crank attached to a lower surface of the back region and coupled to the actuation system to oscillate the back region as the wheel region rotates.

6. The toy of claim 5 wherein the actuation system comprises:

a crank device attached to the crank;

a coupling device attached to the crank device; and a wheel device attached to the coupling device and to the wheel region.

7. The toy of claim 6 wherein:

the crank device includes a crank gear;

the coupling device includes a coupling gear; and the wheel device includes a wheel gear.

8. The toy of claim 6 wherein:

the crank device includes a crank pulley;

the wheel device includes a wheel pulley; and the coupling device includes a coupling belt that wraps around the crank pulley and the wheel pulley.

9. The toy of claim 6 wherein the wheel device is fixed to an axle of the wheel region.

10. The toy of claim 1 further comprising a tail connected to the back region to oscillate as the back region oscillates.

11. The toy of claim 10 wherein the body is shaped like the body of an animal and the oscillation of the back region and the tail is consistent with a wagging movement of the tail of the animal.

12. The toy of claim 1 wherein the back region includes:

a back panel; and cylindrical projections that extend from side surfaces of the back panel;

wherein the cylindrical projections are shaped to fit within cavities of the body.

13. The toy of claim 12 wherein the back axis is defined by the cylindrical projections.

14. The toy of claim 1 further comprising a motor that causes the toy to move in a forward moving direction and a backward moving direction, both directions being perpendicular to the wheel axis and being parallel with the moving direction.

15. The toy of claim 1 further comprising a flexible skin surrounding the body.

16. The toy of claim 1 wherein the body is in the shape of an animal.

17. The toy of claim 16 wherein the body is in the shape of a cat or a dog.

18. A toy comprising:

a body;

a wheel region that rotates about a wheel axis, the wheel region being coupled to the body;

a back region coupled to the body;

an actuation system within the body and coupled to the back region to oscillate the back region about a back axis perpendicular to the wheel axis as the wheel region rotates;

a side panel external to and attached to the body; and an actuating device coupled to the wheel region and to the side panel to oscillate the side panel about a side panel axis that is parallel to the wheel axis as the wheel region rotates.

19. The toy of claim 18 wherein the actuating device includes a protrusion on the side panel that engages a cam on the wheel region.

20. A toy of comprising:

a body;

a wheel region that rotates about a wheel axis, the wheel region being coupled to the body such that the body moves along a moving direction as the wheel region rotates about the wheel axis;

a back region coupled to the body;

an actuation system within the body and coupled to the back region to oscillate the back region about a back axis perpendicular to the wheel axis as the wheel region rotates;

a pendulum rotatably attached to an inside surface of the body and free to oscillate about an axis that is perpendicular to the moving direction, and a pivoting member coupled to the pendulum and to a cavity of the body, the pivoting member being free to oscillate about a pivot within the cavity.

21. The toy of claim 20 wherein the pendulum oscillates in response to successive movements of the toy in a forward moving direction and a backward moving direction.

22. The toy of claim 21 wherein the pivoting member oscillates about the pivot in response to oscillation of the pendulum.

23. The toy of claim 22 further comprising an output device within the body, wherein the controller causes the output device to output a signal when the pivoting member oscillates.

24. The toy of claim 20 wherein at least a portion of the pivoting member is external to the body.

25. A method of moving a toy, the method comprising:

rotating a wheel attached to a body of the toy about a wheel axis to cause the body of the toy to move;

rotating a steering bar fixed to a first portion of the body about a pivoting axis that is perpendicular to the wheel axis; and linking the steering bar with a hinge device that is fixed to a second portion of the body such that the first portion of the body is pivoted relative to the second portion of the body about the pivoting axis wheel axis while the steering bar is rotated and while the body of the toy moves in a direction perpendicular to the wheel axis and the pivoting axis due to rotation of the wheel.

26. The method of claim 25 further comprising determining the position of the first body portion relative to the second body portion.

27. The method of claim 26 wherein pivoting the first body portion relative to the second body portion is based on the determined position.

28. A method of moving a toy, the method comprising:

rotating a wheel attached to a body of the toy about a wheel axis to cause the body of the toy to move;

pivoting a first portion of the body relative to a second portion of the body about a pivoting axis that is perpendicular to the wheel axis while the body of the toy moves in a direction perpendicular to the wheel axis and the pivoting axis due to rotation of the wheel:

oscillating a pendulum rotatably attached to an inside surface of the body about an axis that is perpendicular to the direction in which the toy moves in response to successive movements of the toy in a forward and backward direction, and oscillating a pivoting member coupled to the pendulum and to a cavity of the body in response to oscillation of the pendulum.

29. The method of claim 28 further comprising outputting a signal to an output device within the body when the pivoting member is oscillating.

30. A toy comprising:

a body including a first body portion and a second body portion;

a wheel attached to the body of the toy and able to rotate about a wheel axis to cause the body of the toy to move in a direction perpendicular to the wheel axis; and an actuation system within the body, the actuation system including:

a steering bar fixed to the first body portion, a hinge device fixed to the second body portion, and a linkage rotatable connected to the steering bar and to the hinge device such that as the steering bar is rotated about a pivoting axis that is perpendicular to the wheel axis and the direction of the toy, the first body portion is caused to rotate relative to the second body portion about the pivoting axis.

31. The toy of claim 30 wherein:

the first body portion houses a wiper contact that includes electrically-conductive paths, and the second body portion houses a set of conductive wipers that protrude from a surface of the second body portion and contact the electrically-conductive paths.

32. The toy of claim 31 further comprising a controller coupled to the electrically-conductive paths to determine a location of the first body portion relative to the second body portion.

33. The toy of claim 32 further comprising a sensory region on the body of the toy and coupled to the controller, wherein the controller is coupled to the actuation system to activate the actuation system upon receiving input from the sensory region.

34. The toy of claim 33 wherein the sensory region includes a microphone and the controller activates the actuation system in response to input from the sensory region that indicates a sound has been detected.

35. The toy of claim 30 further comprising a head region attached to the first body portion, wherein the actuation system animates the head region after causing the first body portion to rotate relative to the second body portion.

36. A toy comprising:

a body including a first body portion and a second body portion;

a wheel attached to the body of the toy and able to rotate about a wheel axis to cause the body of the toy to move in a direction perpendicular to the wheel axis;

an actuation system within the body that causes the first body portion to rotate relative to the second body portion about a pivoting axis that is perpendicular to the wheel axis and the direction of motion of the toy;

a pendulum rotatably attached to an inside surface of the body and free to oscillate about an axis that is perpendicular to the direction in which the toy moves, and a pivoting member coupled to the pendulum and to a cavity of the body, the pivoting member being free to oscillate about a pivot within the cavity.

37. The toy of claim 36 wherein the pendulum oscillates in response to successive movements of the toy in forward and backward directions.

38. The toy of claim 37 wherein the pivoting member oscillates about the pivot in response to oscillation of the pendulum.

39. The toy of claim 37 further comprising an output device within the body that outputs a signal when the pivoting member oscillates.

40. The toy of claim 39 wherein the body is in the shape of an animal and the pivoting member is in the shape of a tongue of the animal such that oscillation of the pivoting member resembles a panting motion and the output device outputs a panting sound during the panting motion.

41. A toy comprising:

a body including a first body portion and a second body portion;

a wheel attached to the body of the toy and able to rotate about a wheel axis to cause the body of the toy to move in a direction perpendicular to the wheel axis;

an actuation system within the body that causes the first body portion to rotate relative to the second body portion about a pivoting axis that is perpendicular to the wheel axis and the direction of motion of the toy; and a sensor apparatus within the body that determines a location of the first body portion relative to the second body portion.

42. The toy of claim 41 wherein the sensor apparatus includes:

a wiper contact housed in the first body portion, the wiper contact including electrically-conductive paths;

a set of conductive wipers housed in the second body portion, the wiper set protruding from a surface of the second body portion and contacting the electrically-conductive paths; and a controller coupled to the electrically-conductive paths.

* * * * *